US008092293B2

(12) United States Patent
Richards et al.

(10) Patent No.: US 8,092,293 B2
(45) Date of Patent: Jan. 10, 2012

(54) METHOD AND APPARATUS FOR TRACKING PLAY AT A ROULETTE TABLE

(75) Inventors: Tim Richards, Henderson, NV (US); Rolland N. Steil, Las Vegas, NV (US)

(73) Assignee: IGT, Reno, NV (US)

( * ) Notice: Subject to any disclaimer, the term of this patent is extended or adjusted under 35 U.S.C. 154(b) by 1081 days.

(21) Appl. No.: 11/520,854

(22) Filed: Sep. 13, 2006

(65) Prior Publication Data

US 2008/0076529 A1 Mar. 27, 2008

(51) Int. Cl.
*A63F 9/24* (2006.01)

(52) U.S. Cl. ..... 463/17; 463/25

(58) Field of Classification Search ..... 463/17
See application file for complete search history.

(56) References Cited

U.S. PATENT DOCUMENTS

| | | | |
|---|---|---|---|
| 3,906,460 | A | 9/1975 | Halpern |
| 4,185,730 | A | 1/1980 | Roes et al. |
| 4,319,674 | A | 3/1982 | Riggs et al. |
| 4,531,187 | A | 7/1985 | Uhland |
| 4,674,618 | A | 6/1987 | Eglise et al. |
| 4,725,924 | A | 2/1988 | Juan |
| 4,755,941 | A | 7/1988 | Bacchi |
| 4,758,689 | A | 7/1988 | Nakao et al. |
| 4,764,666 | A | 8/1988 | Bergeron |
| 4,814,589 | A | 3/1989 | Storch et al. |
| 4,827,640 | A | 5/1989 | Jones |
| 4,926,996 | A | 5/1990 | Eglise et al. |
| 4,969,549 | A | 11/1990 | Eglise |
| 4,983,820 | A | 1/1991 | Dias |
| 4,999,742 | A | 3/1991 | Stampfli |
| 5,056,141 | A | 10/1991 | Dyke |
| 5,103,081 | A | 4/1992 | Fisher et al. |
| 5,166,502 | A | 11/1992 | Rendleman et al. |
| 5,216,234 | A | 6/1993 | Bell |
| 5,326,104 | A | 7/1994 | Pease et al. |
| 5,361,885 | A | 11/1994 | Modler |
| 5,399,847 | A | 3/1995 | Druz |
| 5,406,264 | A | 4/1995 | Plonsky et al. |
| 5,498,859 | A | 3/1996 | Farmont |

(Continued)

FOREIGN PATENT DOCUMENTS

| | | |
|---|---|---|
| EP | 0057602 | 11/1982 |

(Continued)

OTHER PUBLICATIONS

Edward 0. Thorp, Beat the Dealer, 1966, pp. 116 and 117.
Bill Zender, Card Counting for the Casino Executive, 1990, pp. 70,72, 74, and 76.
Don Schlesinger, Blackjack Attack Playing the Pros' Way, 3rd Edition-The Ultimate Weapon, 2004, pp. 16, 492, and 493.
International Gaming & Wagering Business, Table Game Trends 2004, 22 pages.
Digi Deal Corporation, Digital 21 "The Classic Game", 2005, 1 page.
Mikohn Gaming Corporation, Tablelink Total View The New Standard In Table Games, 2005, 11 pages.

(Continued)

*Primary Examiner* — Corbett B Coburn
(74) *Attorney, Agent, or Firm* — K&L Gates LLP

(57) ABSTRACT

A wagering monitoring system configured to detect player wagers at a roulette table. A table having antennas associated with the various wagering areas is provided for the players. A reader connects to each antenna to thereby communicate via the antenna with tokens equipped with an identification element. By monitoring wagers, game play is monitored and processing may occur to track each player wager and the amount wagered by each player. To facilitate play at a roulette table, the identification element associated with each token includes a token color identification code which identifies the color of the token. The token color identification code is associated with a specific player which in turn provides means to associated each wager and a total amount wagered with that player.

12 Claims, 13 Drawing Sheets

U.S. PATENT DOCUMENTS 5,505,449 A 4/1996 Eberhardt et al.
5,588,649 A 12/1996 Blumberg et al.
5,619,066 A 4/1997 Curry et al.
5,651,548 A 7/1997 French et al.
5,676,376 A 10/1997 Valley
5,706,925 A 1/1998 Orus et al.
5,707,287 A 1/1998 McCrea, Jr.
5,722,893 A 3/1998 Hill et al.
5,735,742 A 4/1998 French
5,743,798 A * 4/1998 Adams et al. ..... 463/17
5,764,789 A 6/1998 Pare, Jr. et al.
5,770,533 A * 6/1998 Franchi ..... 463/42
5,781,647 A 7/1998 Fishbine et al.
5,785,321 A 7/1998 van Putten et al.
5,803,808 A 9/1998 Strisower
5,809,482 A 9/1998 Strisower
5,855,515 A 1/1999 Pease et al.
5,890,717 A 4/1999 Rosewarne et al.
5,892,210 A 4/1999 Levasseur
5,895,321 A 4/1999 Gassies et al.
5,902,983 A 5/1999 Crevelt et al.
5,910,048 A 6/1999 Feinberg
5,919,090 A 7/1999 Mothwurf
5,941,769 A 8/1999 Order
5,957,776 A 9/1999 Hoehne
6,003,651 A 12/1999 Waller et al.
6,021,949 A 2/2000 Boiron
6,032,955 A 3/2000 Luciano et al.
6,039,650 A 3/2000 Hill
6,048,269 A 4/2000 Burns et al.
6,050,895 A 4/2000 Luciano, Jr. et al.
6,062,981 A 5/2000 Luciano, Jr.
6,099,408 A 8/2000 Schneier et al.
6,102,400 A 8/2000 Scott et al.
6,109,530 A 8/2000 Larson et al.
6,126,166 A 10/2000 Lorson et al.
6,148,094 A 11/2000 Kinsella
6,165,069 A 12/2000 Sines et al.
6,186,895 B1 2/2001 Oliver
6,193,153 B1 2/2001 Lambert
6,200,218 B1 3/2001 Lindsay
6,257,979 B1 7/2001 Walker et al.
6,264,109 B1 7/2001 Chapet et al.
6,267,671 B1 7/2001 Hogan
6,270,410 B1 8/2001 DeMar et al.
6,296,190 B1 10/2001 Rendleman
6,299,536 B1 10/2001 Hill
6,330,162 B2 12/2001 Sakamoto et al.
6,357,746 B1 3/2002 Sadowski
6,358,149 B1 3/2002 Schneider et al.
6,460,848 B1 10/2002 Soltys et al.
6,464,584 B2 10/2002 Oliver
6,514,140 B1 2/2003 Storch
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,533,276 B2 3/2003 Soltys et al.
6,533,662 B2 3/2003 Soltys et al.
6,558,255 B2 5/2003 Walker et al.
6,561,897 B1 5/2003 Bourbour et al.
6,579,180 B2 6/2003 Soltys et al.
6,579,181 B2 6/2003 Soltys et al.
6,581,747 B1 6/2003 Charlier et al.
6,582,301 B2 6/2003 Hill
6,595,857 B2 7/2003 Soltys et al.
6,609,710 B1 8/2003 Order
6,612,928 B1 9/2003 Bradford et al.
6,619,662 B2 9/2003 Miller
6,626,757 B2 9/2003 Oliveras
6,629,019 B2 9/2003 Legge et al.
6,629,591 B1 10/2003 Griswold et al.
6,629,889 B2 10/2003 Mothwurf
6,638,161 B2 10/2003 Soltys et al.
6,652,379 B2 11/2003 Soltys et al.
6,659,875 B2 12/2003 Purton
6,663,490 B2 12/2003 Soltys et al.
6,671,358 B1 12/2003 Seidman et al.
6,685,564 B2 2/2004 Oliver
6,685,568 B2 2/2004 Soltys et al.
6,688,979 B2 2/2004 Soltys et al.
6,690,673 B1 2/2004 Jarvis
6,709,333 B1 3/2004 Bradford et al.
6,712,696 B2 3/2004 Soltys et al.
6,733,388 B2 5/2004 Mothwurf
6,747,560 B2 6/2004 Stevens, III
6,758,751 B2 7/2004 Soltys et al.
6,834,251 B1 12/2004 Fletcher
6,843,725 B2 1/2005 Nelson
6,848,994 B1 2/2005 Knust et al.
6,896,618 B2 5/2005 Benoy et al.
6,932,703 B1 8/2005 Ritchie
6,967,563 B2 11/2005 Boremaster
7,018,291 B1 3/2006 Lemke et al.
7,152,045 B2 12/2006 Hoffman
7,172,507 B2 2/2007 Fujimoto et al.
7,204,428 B2 4/2007 Wilson
7,329,186 B2 * 2/2008 Griswold et al. ..... 463/29
2003/0195025 A1 10/2003 Hill
2004/0198484 A1 10/2004 Johnson
2005/0022771 A1 2/2005 Cicone
2005/0026674 A1 2/2005 Wolf et al.
2005/0082750 A1 4/2005 Grauzer et al.
2005/0212214 A1 9/2005 Pfeiffer et al.
2005/0219599 A1 10/2005 White et al.
2005/0225080 A1 10/2005 Wicker
2006/0058085 A1 3/2006 White et al.
2006/0071427 A1 4/2006 Van Dyke
2006/0094498 A1 5/2006 Jorasch et al.
2006/0177109 A1 8/2006 Storch
2006/0281537 A1 12/2006 Abbott et al.
2007/0026204 A1 2/2007 Caulley et al.
2007/0029394 A1 2/2007 Wicker et al.
2007/0035399 A1 2/2007 Hecht et al.
2007/0045957 A1 3/2007 Blair, Jr.
2007/0045958 A1 3/2007 Rader et al.
2007/0057469 A1 3/2007 Grauzer et al.
2007/0060311 A1 3/2007 Rowe et al.
2007/0167206 A1 7/2007 Kirkutis
2008/0076529 A1 3/2008 Richards et al.
2009/0124377 A1 5/2009 Rader et al.

FOREIGN PATENT DOCUMENTS

EP 0360613 A2 3/1990
WO WO 98/35309 8/1998
WO WO 99/19027 4/1999
WO WO 00/22585 4/2000
WO WO03013673 2/2003
WO WO03026381 4/2003
WO WO 2006/037220 4/2006
WO WO2006041765 4/2006
WO WO2007075380 7/2007

OTHER PUBLICATIONS

Gaming Partners International, RFID Gaming Chips, 12 pages.
Biometrica Systems, Inc., Visual Casino Products, 3 pages.
TCS John Huxley, Protec 21 Blackjack Security, 2005, 2 pages.
"What Is SafeJack™"; Mikohn; flyer; 2 pages; Date Unknown.
"TableLink™ The New Standard in Table Games"; Mikohn; brochure; 18 pages; 1999.
"TableLink A New Standard In Table Games"; Mikohn; brochure; 4 pages; Date Unknown.
Hasbro Inc., Trivial Pursuit 10$^{th}$ Anniversary Edition Master Game, 1992, <URL:http://www.hasbro.com/common/instruct/Trivial Pursuit (10th anniversary edition mastergame) (1 page).
Thomas Lucas M., Ninja Gaiden II: The Dark Sword of Chaos Review., 1990, URL:http://wii.ign.com/articles/827/827325p1.html (2 pages).
A Day on the Surface: A Hands-On Look at Microsoft's New Computing Platform Article printed from http://arstechnica.com/microsoft/news/2007/09/surface.ars/ on Jun. 9, 2010 (7 pages).

* cited by examiner

METHOD AND APPARATUS FOR TRACKING PLAY AT A ROULETTE TABLE

FIELD OF THE INVENTION

The invention relates to wagering game monitoring and in particular to a method and apparatus for monitoring wager to prevent or track wager amounts and to monitor for cheating.

RELATED ART

Gambling has become a popular form of entertainment in the United States and in numerous foreign countries. Although numerous wagering events are offered within the casino or other gaming environment, one of the most traditional and popular forms of wagering occurs at table games. As is widely understood, traditional table games utilize a playing surface, often called a felt, upon which a dealer or other game operator offers a wagering event to one or more players or upon which a player may make a bet or wager.

As compared to slot or video type games, traditional table games offer greater excitement for some players, group play, and often attract big money players, which can result in larger profit margins for the casino. Slots or video type games, however, often integrate a player tracking system that allows a computerized system to monitor a player's participation, such as how often a player plays and how much a particular player wagers. Furthermore, electronic gaming machines, such as slot or video type machines accurately detect wagers and payouts and thus are very efficient at preventing cheating. In a table game environment however, it is often difficult to track how much money a player wagers and thus it is likewise difficult to accurately provide complimentary gifts or reward good customers to encourage a return to a particular property. Prior art systems use gaming tokens embedded with Radio Frequency Identification ("RFID") to track a player's betting for this purpose. An example of such a system is the Mikohn® Gaming Corporation's d/b/a Progressive Gaming International Corporation's Tablelink® product.

However, even with prior art bet tracking techniques, numerous wagering aspects may be missed or unmonitored. In addition, payouts are not tracked. This results in a potential for cheating and may not accurately track the true nature of a player's wins and losses. In a table game environment, this may lead to difficulty in accurately 'comping' or rewarding good customers to encourage a return to a particular property.

Furthermore, a limited group of players or even casino personnel may actually attempt to cheat during game play. To prevent such cheating, a myriad of human game protection elements are employed in a casino to monitor table games. The monitors comprise of pit bosses, dealers, video surveillance personal, security guards, and the like. However, these individuals cannot monitor every bet, and are an expensive option for a casino.

Some prior art monitoring systems track a bet by a player, although such tracking is insufficient because only some bets are monitored or the monitoring is highly inaccurate. Another draw back of prior art systems is that while such systems may track a wager, it does not reveal other cheating techniques that a dishonest player or dealer may employ.

The method and apparatus described below overcomes these drawbacks and provides additional benefits.

SUMMARY

To overcome the drawbacks described above and provide additional benefit, a roulette game bet detection system is disclosed. In one embodiment, this system comprises a game table surface configured with a plurality of betting areas and two or more game tokens such that each game token includes a token identification element. The token identification element further comprises memory configured to store token data comprising a token value, a token serial number and a token color code identification. Also part of this system is at least one antenna associated with the betting areas, wherein the antenna establishes a detection zone. The antenna may communicate with a reader connected to the antenna. In this embodiment, the reader is configured to read a first color game token having a first color code identification and a second color game token having a second color code identification when both are located in the same detection zone. The system then communicates the first color code identification and the second color code identification to a computer which in turn enable the computer to determine that wagers from different players are placed within a same detection zone.

In one embodiment, the two or more tokens comprise tokens of different colors and the game table surface is configured in a roulette table layout. The token color code identification may represent an individual player. In addition, the system may further comprise the computer such that the computer is further configured with machine readable code configured to track a total value of bets made using game tokens having a particular color code identification. It is contemplated that the machine readable code may be further configured to associate a player with a token color. It is also contemplated that the game table surface may be further configured with an association area where a player identification may be associated with a token color. In addition, the computer may be configured to determine if game tokens located within a detection zone satisfy game rules and, if the game rules are not satisfied, then the computer may generate an alert. As disclosed herein is the system configured so that the bet detection system further comprises a roulette wheel monitor to detect the status of the roulette wheel.

Also disclosed herein is a method of identifying betting activity during a game of roulette. This method utilizes a plurality of game tokens such that each game token includes a token identification element and the token identification element further comprises memory configured to store token data comprising a token value, a token serial number and a token color identification code. The token color identification code corresponds to a color of the token. Also used by this method is a game table surface configured with a plurality of betting areas. During operation, the method assigns a token color to a player such that the player places bets using only tokens of the assigned token color. Then this method receives a wager at a first betting area from a first player in the form of one or more tokens having a first assigned token color and also receives a wager at the first betting area from a second player in the form of one or more tokens having a second assigned token color. The method then reads token data from the tokens at the first betting area and processing the token data such that the processing comprises calculating the amount bet by the first player and the amount bet by the second player based on the token color identification code.

In one embodiment the step of assigning a token color to a player comprises associating the token color identification code with a player identification. In addition, assigning a token color to a player may comprise placing a token having a color assigned to a player in an association area with a player identification element where the player identification data is readable by a reader. This method then reads the token color identification code and the player identification data from the player identification element and associates the token color identification code with the player identification data.

In one embodiment, reading comprises providing a signal to an identification element, which in turn, causes the identification element to generate a return signal comprising token data which is read by a reader. The association area comprises an area of the game table having an antenna in proximity thereto to thereby read both the player identification data and the token color identification code. In one variation, the method further comprises rewarding a player based on the amount bet based on the processing the token data, regardless of the outcome of the game of roulette. It is contemplated that the token identification element comprises a radio frequency identification tag and that a computer may generating an alert if a wager violates a wagering rule.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

FIG. 7 illustrates an operational flow diagram of one example embodiment method of operation of tracking player buy-in.

DETAILED DESCRIPTION

Figure 1:
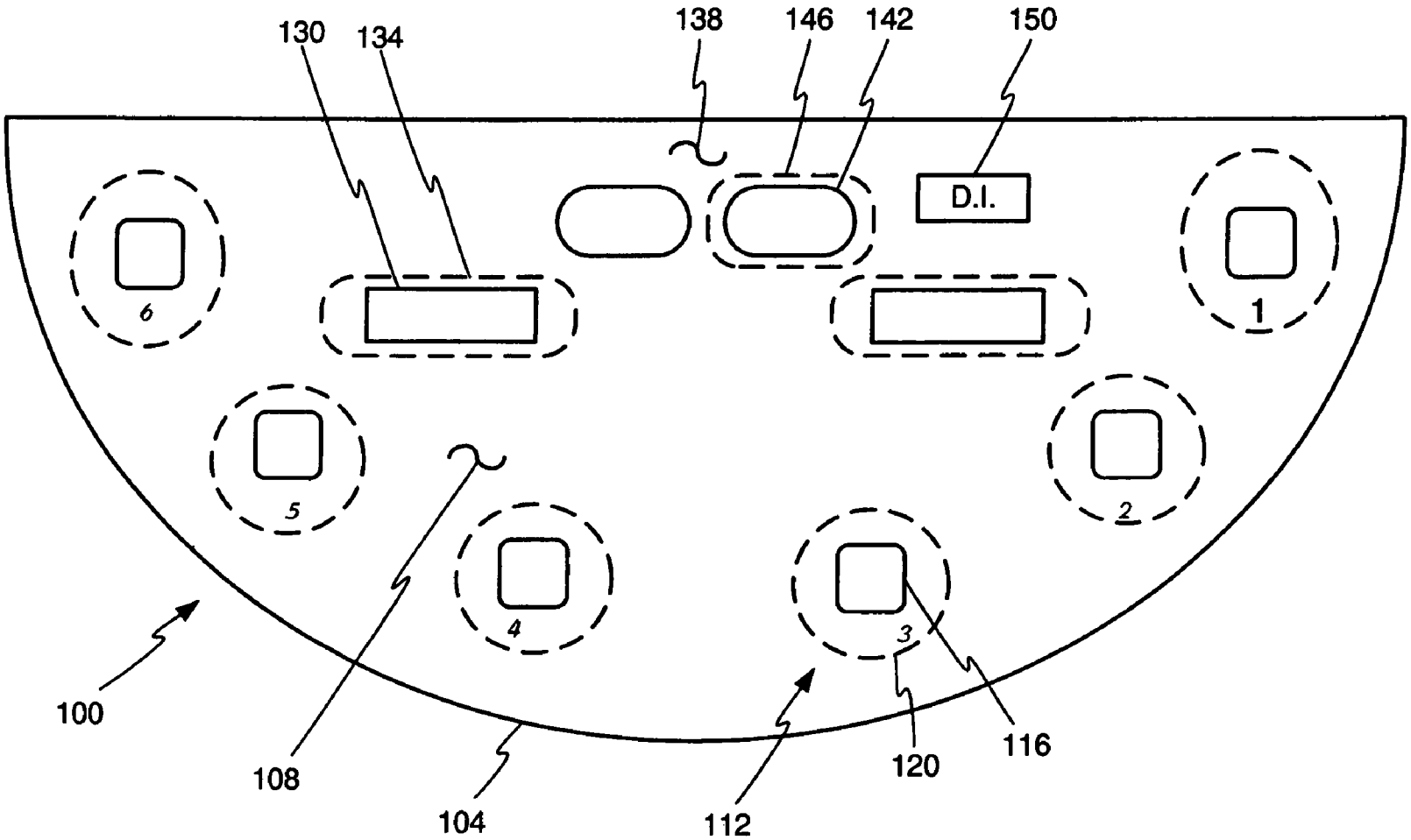
FIG. 1 illustrates a top plan view of an example embodiment of a table for use with a table game.

FIG. 1 illustrates a top plan view of an example embodiment of a gaming table for use with a table game. This is but one possible table arrangement and layout and it is contemplated that one of ordinary skill in the art may arrive at other table arrangements to promote game play or accommodate a greater or fewer number of players. For example, it is contemplated that the method and apparatus described herein may be utilized with any game layout. Likewise, the table can be configured in a stand-up or sit down arrangement. In this example embodiment the table 100 includes an outer edge 104 surrounding a generally flat top surface 108. The table may also be configured to accommodate other types of traditional table games including, but not limited to, dice games such as a modified form of craps, poker, baccarat, or non-proprietary table games such as roulette, and other games which use dice, wheels, or cards or any combination of dice, wheels, or cards. Table games include games of chance that use cards or dice, and tokens, such as chips of differing values. Traditional table games also include proprietary games such as Caribbean Stud Poker® which include a progressive jackpot. Other proprietary traditional table games include games such as Three Card Poker®, Royal Match 21® and Texas Hold'em Bonus™. Proprietary table games are table games for which a casino will lease or purchase from a manufacturer because the proprietary traditional table game is protected by the intellectual property of the manufacturer. The term "traditional table game" is used to distinguish from products offered by TableMAX® and Digideal's Digital 21™ which use video representations of cards. There are other non-traditional table games that have digital roulette wheels with video or digital images of dealers.

In this example embodiment of a table, configured for use with the game of black jack, there is an outer edge 104 of the table 100. One or more player stations 112 are provided and configured for use by a player to participate in a waging game or a game of chance offered at the table such as blackjack. In this embodiment the player stations 112 comprise a bet spot 116 wherein a player may place one or more wagers during the course of play. For example, the player may place the chips or tokens within area 116 when placing a bet during the course of play. Overlapping the bet spot 116 is a detection zone 120. The detection zone 120 comprises a zone within which a bet detection system, described below, may detect the token, such as an amount bet by a player at a player location 112 or player station at the table 100. Likewise, other data stored on the token may be detected by the bet detection system.

In other various embodiments, one or more supplemental bet spots may be located in one or more other locations on the table surface 108. By way of example, a supplemental bet spot 130 may be located as shown and shared by more than one players. A supplemental detection zone 134 may likewise be associated with the supplemental bet spot 130 to detect a bet therein. The supplement bet spots may also comprise token buy-in spots that have detection capability to detect player's buy-in. A supplemental detection zone could also be added to detect multiple bets that are required or optional by a player in proprietary table games such as Caribbean Stud Poker®, Three Card Poker®, Royal Match 21®, Texas Hold'em Bonus™, and Two Card Joker Poker™.

In this example embodiment a dealer position 138 is located generally opposite one or more of the player positions. As is generally understood, the dealer presents the game from the dealer station 138. Associated with the dealer station 138 are one or more dealer spots 142 which in turn may be associated with one or more dealer detection zones. The dealer spot 142 is a location on or in some way associated with the table and/or the dealer on which tokens may be placed for detection by the detection system. As used herein, the term token may refer to a DID type token. The dealer detection zone 146 is the area in which the detection system can detect tokens placed in the dealer spot 142. This dealer detection zone 146 could be used in player banked traditional table games such as those played in the State of California or other jurisdictions. The dealer detection zone 146 may also be used to hold ante bets contributed by players in Class II gaming jurisdictions such as Native American gaming establishments in the State of Florida.

A dealer interface 150 may also be place near the dealer position 138. The dealer interface 150 comprises a user interface configured to allow the dealer to provide input to the detection system and optionally receive input from the detection system. In various embodiments, the dealer interface 150 comprises one or more buttons, dials, display screens, lights or other illumination devices, speakers or other audible indicators, or analog dials, potentiometers, or keypads. Through use of the dealer interface 150, the dealer is able to provide input to the detection system or receive data from the detection system.

Figure 2:
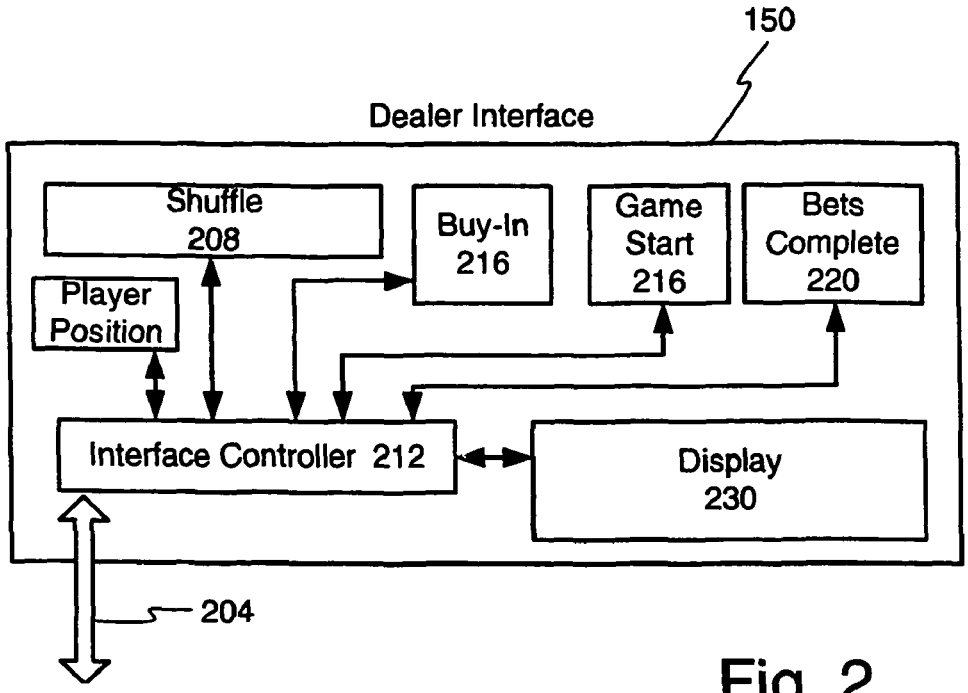
FIG. 2 illustrates a block diagram of an example embodiment of dealer interface.

FIG. 2 illustrates a block diagram of an example embodiment of dealer interface, such as dealer interface 150, shown in FIG. 1. This is but one possible example embodiment and it is contemplated that other embodiments may be created which utilize additional or fewer components and modes of operation. As shown, a dealer interface 150 comprises an input/output port 204 that connects to an interface 212. The interface controller 212 is configured to control input and output from the dealer interface 150 to the detection system. The interface controller 212 may comprise any device or element configured to perform as described herein. Connecting to the interface controller 212 is a shuffle indicator button 208, a game start button 216, a bets placed button 220 and a one or more other optional buttons or inputs which may be configured as desired. A display 230 may also be provided to provide information, alerts, or data to the dealer. A speaker or other audio device (not shown) may also be provided.

The shuffle indicator button 208 comprises a dealer input device or indicator that the dealer may utilize to provide an input to the detection system that a shuffle has just occurred or is about to occur. Another shuffle indicator may come from an attached card shuffler mechanism. Either method provides data to the system to signal when dealing from a newly shuffled shoe is about to occur. The game start button 216 comprises an indicator that the dealer may utilize to provide an input to the detection system that a new game is about to begin. As used herein, a game start is defined as a dealing of a round of cards or other indicia to the players. In other games, other events may define the start of a new game. It is contemplated that multiple games may occur between shuffles of the deck.

Of course, in embodiments which utilize indicia other than cards, such as games that utilize dice or wheels, other buttons with different labels may be utilized to achieve the method and apparatus as described herein. It is also contemplated that the dealer interface 150 may include a keyboard and/or a display to thereby provide means for the dealer to input player information and player position. The dealer interface 150 may also be equipped with a player tracking interface to accept and read player tracking cards and to be able to receive number or letter codes for a player. The player tracking interface will lock in a name or code to identify each player using a player location 112. The player tracking interface can be operated by the dealer or pit supervisory personnel to provide this Player Lock-In Data.

The bets complete button 220 may be utilized when all the bets for a particular round of play have been placed and hence, any additional bets or changes to the bet pattern may be in violation of the game rules. It is further contemplated that a button may also be included on the interface 150 to indicate that bets are being allowed or accepted. This may also be used during a payout or bet collection period.

The display 230 may comprise any type of display capable of providing information to the dealer or other casino personnel. Any type of information may be provided. In one embodiment alerts regarding detected events may be shown on the display, such as but not limited to, players changing their bets or bets being placed at the incorrect time. Other uses for the display may indicate that a player or players on the table that are currently betting, wagering, or playing a round may have won a special prize or award.

Figure 3:
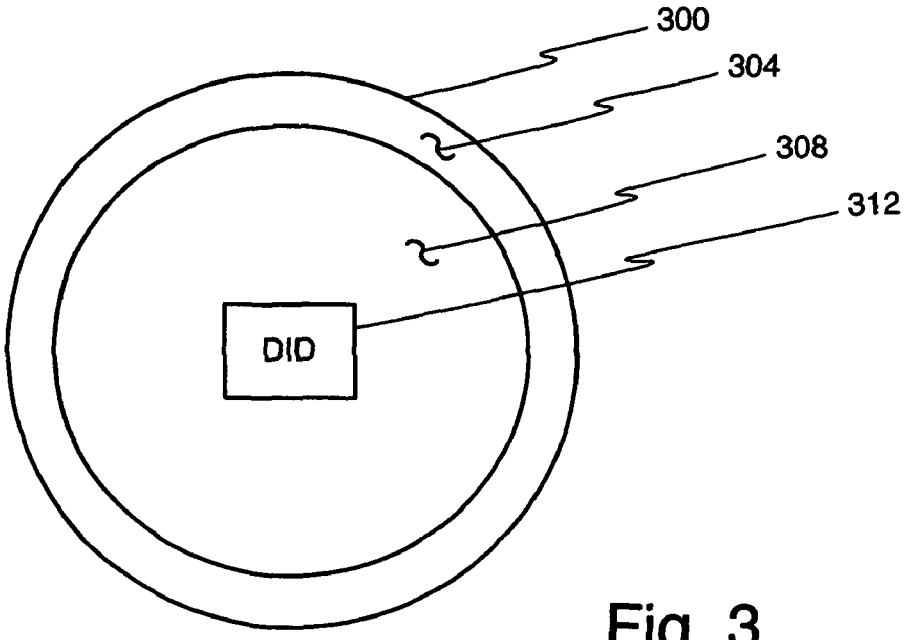
FIG. 3 illustrates a top plan view of a token equipped with detectable identification.

FIG. 3 illustrates a top plan view of a token equipped with detectable identification (hereinafter DID). The term DID is defined to mean any technology that may be associated with the token or in any way imbedded within the token to allow for detection of the token using sensing technology. One example of DID technology is radio frequency identification (RFID) technology wherein a sensor is imbedded within a token and the sensor may be activated or powered using an antenna and/or energy emitting device thereby causing the DID to emit data. RFID tokens are available from Gaming Partners International, located in Las Vegas, Nev.

As shown in FIG. 3, a token 300 comprises an outer surface and edge often formed in a coin shape. An outer rim 304 may be provided with markings and to provide support to the structure of the token 300. Inside the area defined by the outer ring 304 is a middle area 308 of the token 300. The middle area, or other area of the token, includes a DID element 312 that may be configured to identify any type of information associated with the token. The information stored or associated with the DID may comprise the value assigned to the token; an identification code or serial number (which is typically unique); player information, if so assigned, a client or casino name, secret data, encryption information or codes, public information, physical chip size, data regarding memory, creation or in use date, DID type or family.

In one example embodiment the token 300 and DID technology 312 comprise a microchip having read and write memory, such as for example 256 bits, with one or more configurable sections to meet the particular application. Data may be entered into the DID device and sealed or encrypted to prevent fraud or tampering. In one embodiment, at least some of the data stored within the DID device may be changed or updated by a casino or when provided to a player.

Figure 4:
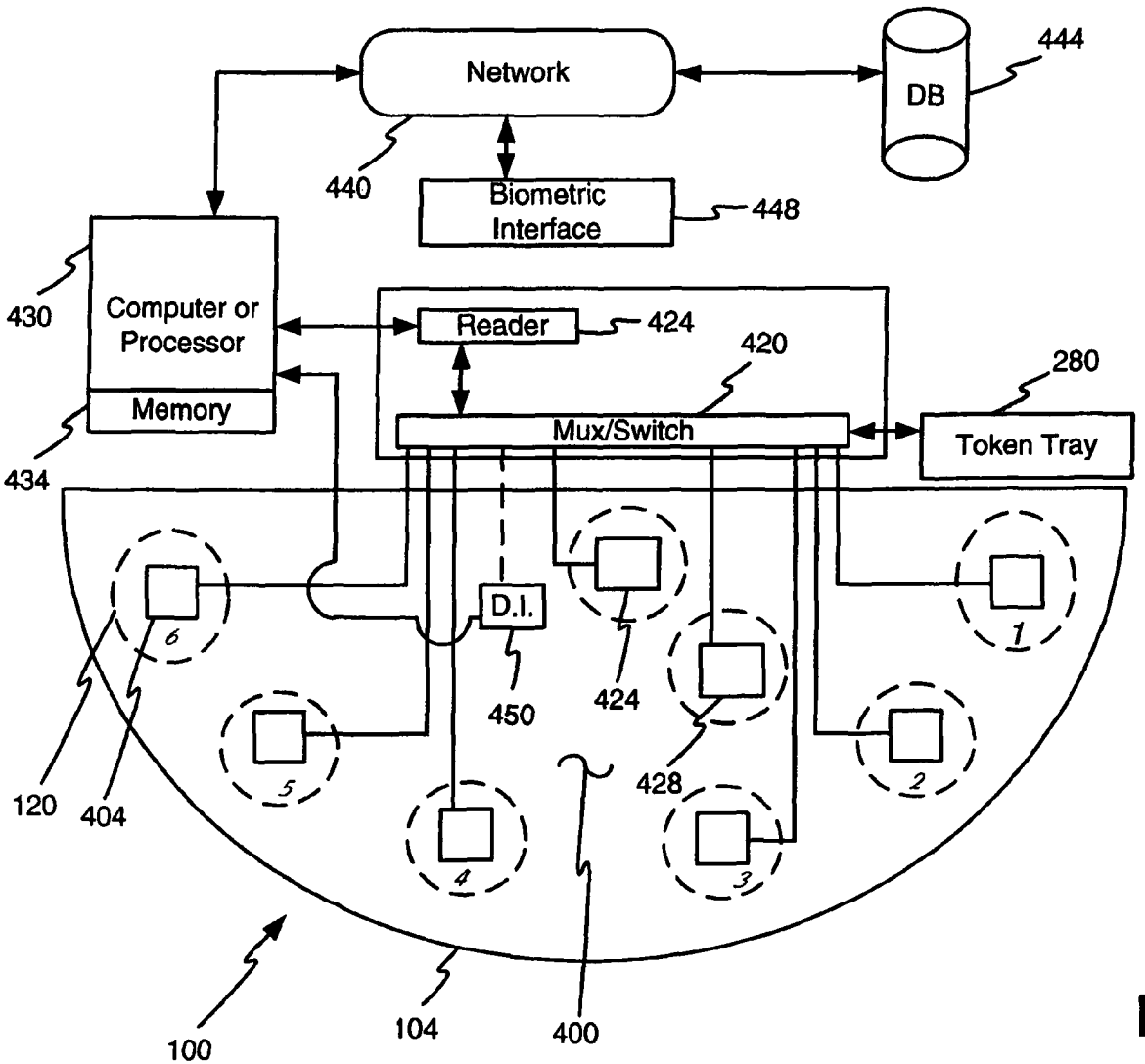
FIG. 4 illustrates a block diagram of a detection system in connection with a game table.

FIG. 4 illustrates a block diagram of the detection system in connection with a game table. This is but one possible example configuration and the elements as shown are for purposes of discussion and hence are not to scale. As part of the table 100, there is an underside 400 of the table, which is shown in FIG. 4. As way of reference, the outer surface 104 and player positions 1-6 are shown. A DID antenna 404 may be mounted below the table 100, be integral with the table, or on the top of the table. In this embodiment the DID antenna 404 is below or on the underside 400 of the table and creates a detection zone 120 when so instructed by the detection system described above. The detection zone 120 may also be understood as the area in which the energy emitted by the antenna energizes the DID detectable identification of the token.

The DID antenna 404 connects to a multiplexer, diplexer, or switch 420, which in this embodiment controls communication between a reader 424 and the antenna 404. It is contemplated that communication between the reader 424 and the one or more antenna 404 is bi-directional such that the reader may provide an electrical excitation signal to the antenna 404. The antenna 404 converts the electrical signal to an electromagnetic field (EMF), which excites or powers the DID aspects of the token located within the detection zone. As a result and in response to the excitation EMF signal, the antenna may also detect data emitted from the DID device. The data is sent back, via the multiplexer 420, to the reader 424.

A token tray 280 may also be provided that reads and/or writes to any token within the tray, reports newly incoming tokens and outgoing tokens. This provides the monitoring system with data regarding the tokens purchased by or paid out to players and tokens collected from players. This allows the system to further track incoming and outgoing tokens.

Tokens purchased by a player and not passing through the token tray 280, i.e. won or cashed in, may be assumed to have left with or been kept by the player. Tokens presented for play on the table that do not pass through the token tray 280 may be assumed to have been brought to the table by the player.

In one embodiment, the electronic readable token tray can provide token inventory information within any four wall casino or multi site casinos and managed by any software that is separate or part of the full player tracking system that in turn will provide, at a moments notice, the entire banked token inventory, each token tray inventory, floating token inventory (tokens not in play and not in the bank), and notification when a de-issued token has been received or played.

Operation of the other DID antenna associated with the other player stations occurs as described above. A dealer DID antenna 424 is also provided with the associated detection zone. One or more secondary bet or token spot antenna 428 with associated detection zone is also provided as shown. These elements 424, 428 also connect to the multiplexer/switch 420. Hence, the reader 424 may selectively read the DID information contained within the tokens placed at the bet spots as shown in FIG. 1 during the course of game play. A device other than a multiplexer may be used to concurrently energize more than one antenna to speed the read process. A dealer interface 450 also connects to a monitoring system, such as to a computer 430, or via the multiplexer 420 to thereby provide input to the computer 430, such as shuffle and new game data, place bets data, no bets accepted data or any other indication signals. The detection system on the computer 430 may also detect if bets are made or changed at times that are not allowed.

The reader 424 connects to any type processor which may be embodied in a computer 430 having memory 434. The computer is configured to execute machine readable code which may be stored on the memory 434. The machine readable code may comprise software code or code logic capable of interaction with other systems, such as the reader. The computer 430 may include an input interface for receiving input from a user such as pit supervisory personnel or dealer, such as a keyboard, analog dial, potentiometer, mouse, touch screen, or any other device capable of providing information to the computer. The computer 430 may also be configured with one or more displays. The computer 430 will allow the input of information by pit supervisory personnel and/or a dealer.

In the embodiment shown in FIG. 4, the computer 430 connects to a network 440 which in turn may connect to a database 444 and/or a biometric interface 448. A database 444 is generally understood in the art as an accessible memory for storing accessible data. The network 440 may include access by surveillance personnel in the casino.

The biometric interface 448 comprises any type system configured to monitor and identify players based on one or more player characteristics. In one such configuration a camera is capable of capturing a player's picture, such as of their face, and the biometric system compares the player's picture to a data base of known dishonest players or banned individuals. The biometric system 448 in connection with the bet detection system may be utilized to monitor for and identify certain players who may be attempting to gain an unfair advantage. One exemplary biometric system is available from Biometrica Systems, Inc in Las Vegas, Nev.

It is also contemplated that the computer 430 and the network 440 may be equipped to send and receive e-mail or other forms of electronic output. In one embodiment, the detection system, such as the computer 430, the network 440, or a mail server associated with the network, may be controlled to send e-mail, voice messages, or other notification to a party to alert or notify them of information generated by the detection system.

Figure 5:
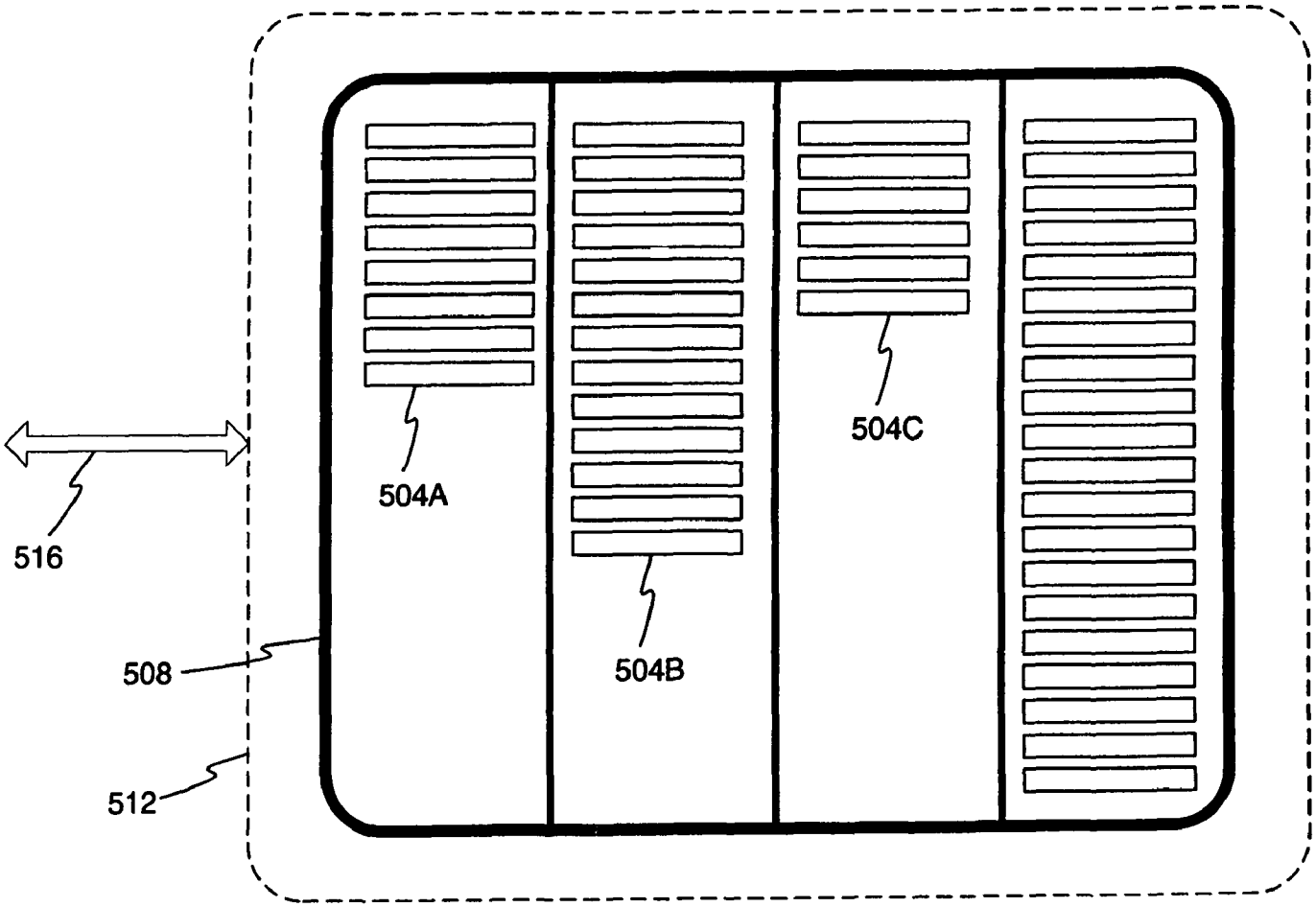
FIG. 5 illustrates a top plan view of a token tray with a DID (detectable identification) reader.

FIG. 5 illustrates a top plan view of an example embodiment of a token tray. Token trays are generally understood in the art and hence are not described in detail. In this example embodiment one or more tokens 504A, 504B, 504C are stacked in the tray 508. The tray 508 may be configured with different sections or dividers to separate tokens of different value. For example, tokens 504A may be of different value than tokens 504B, which also are of different value than tokens 504C. Integrated within or part of the tray 508 is a detection zone or reader apparatus 512 configured to read the value or data from the tokens in the token tray. An output 516 may be provided to allow for output from the tray, such as to the detection system or the data may be transmitted wirelessly. It is also contemplated that the token tray 508 may be placed on a detection zone that is located on the table. This provides portability to the token tray 508 while still allowing for detection of the tokens 504 in the tray.

Operation

In operation, the system shown in FIG. 4 operates to monitor tokens on the table. Numerous different aspects or methods of monitoring the tokens on the table are possible and each is discussed below in more detail.

When the tokens are monitored or detected, in the various manners described below, the token information may be provided to the computer, processed in the manner described below, and output to a dealer, pit supervisory personnel, surveillance, casino hosts, or other third party. In one embodiment the processing may occur at the table itself such as with a controller or control logic, and not at the computer.

The bet detection system may be configured in any desired manner, such as described below. In general, the detection system detects tokens on the table. In one embodiment the detection system is configured to detect players attempting to obtain an unfair advantage by adjusting their bets during periods in which bet alteration is prohibited. In other embodiments, as discussed herein, the detection system is utilized for other monitoring and reporting functions.

Although operation of a gaming table is generally understood, a brief description is provided with focus on operation of the detection system as shown in FIG. 1 and FIG. 4 and reference to other figures occurs to aid in understanding. After shuffling of one or more decks of cards by hand or through an automatic card shuffler, to insure fair and random game play, the dealer may optionally press the shuffle button 208 of the dealer interface 150 to notify the detection system that dealing will occur from a newly shuffled deck or decks of cards dealt by hand or by a shoe. Likewise, to indicate the start of a new game, the dealer may press the game start button 216 to indicate the beginning of a new game. In the game of blackjack, a game ends after: (1) All players cease taking additional cards either by choice or by receiving a total of 21 or higher; and (2) The dealer receives a total of 21 or higher or stops taking additional cards according to preset rules. It is anticipated in the game of blackjack that there may be more than one game before a shuffle is necessary, although shuffle may occur every game. Other games will operate under different rules than blackjack. Alternatively, the use of the shuffle button may also indicate the beginning of a new game, but only a new game after a shuffle.

The dealer may then accept wagers, deal the cards to the players and conduct the game as would be understood. When a player places a bet at a player bet spot, one or more detectors detect placement of the token placed within the detection zone. The detector provides this information to the detection system. After a round of betting is complete, the dealer may press the bets complete button on the interface to signal that the betting period is closed.

During the play of a game such as blackjack, supplemental bets such as double down, splitting and insurance by the player may be allowed by the game rules and thus can be detected by the detection system as valid betting. The supplemental bets can be detected by the detection system either by human intervention by using the dealer console or by game analysis software that monitors playing cards, or other indicia, and betting data in real time and thus verify that the player has right to add supplemental bets against the rules of the particular game being played and monitored by the detection system. After completion of the game, the dealer may pay winning hands including any supplemental bets and the payouts given to each winning player may optionally be detected to verify correctness in pay. The dealer interface may be used as part of this process. Prior to the start of a new game, i.e. dealing of the cards, the dealer may press the game start button to indicate to the detection system the start of a new game, and hence a new round of betting is ready for detection by the detection system. Other input may be provided to the dealer interface or via other components of the detection system.

One or more methods of operation are now described.

Bet Tracking

In one embodiment, the detection system operates to detect wagers by a player. The detection system, configured as described above, detects a wager by a player, such as during a first round of betting. The detection system may also detect supplemental bets by the player. Operating in this manner, the total amount bet by a player may be monitored and tracked.

Bets may be associated with a player in any manner. In one embodiment the tag or id of the DID token is associated with the player when the player purchases or obtains the tokens. In another embodiment the position at which the bet is placed is attributed to the player. It is contemplated that the detection system associated with a table polls the table sufficiently rapidly to detect supplemental bets. In one embodiment the table is polled once every two seconds. In one embodiment the detection system polls the table once every second. In one embodiment the detection system polls the table multiple times per second. The term polls the table is defined to mean reading one or more tokens in one or more detection zones.

Bet tracking to associate and accurately recognize the amount bet by a player provides the advantage of accurately tracking a player's total amount bet over time or at a particular point in time. This data can be used for numerous purposes. Bet amount tracking data may be used to more accurately compensate players deserving of compensation, such as with free rooms or meals. Another reason to accurately track bet amounts is to focus appropriate marketing or advertising efforts on the appropriate players that are more likely to play more and thus increase the casino's profits over time.

One advantage over prior art systems that attempted to track wager amounts using bet detection, the method and apparatus described herein is highly accurate, such as compared to overhead cameras or table optical sensors, and is capable of detecting chips which may have multiple stacks of tokens. This is a particular advantage where each stack can contain multiple tokens and where tokens of one likeness may be hidden or optically blocked by other tokens of another likeness, such as used in Roulette where multiple colors are used and each color on the table represents individual bettors or players. Likewise, the present invention is capable of detecting supplemental bets, such as but not limited to double down, splits or insurance in blackjack. Consecutive polling of the table within the time frames set forth herein by the detection system provides the benefit of detecting tokens during regular game play. By consecutively and continuously polling all bet detection zones within a table during the framing of a game round (the period between game begin signal and game end signal), the bet detection system can monitor and store the differences against the initial bet placed by the player in a near real time period. Monitoring the bets in real time or close thereto, the detection system can decide, based on game rules, that the differences in bets on each position or by differentiating color codes is either valid and allowed by the game rules or that the player may be cheating by adding or subtracting bets when the game is in favor or out of favor for winning that hand in the game round. In the case of bets being changed that do not follow the rules of the game, the bet detection system can then be set to alert casino personnel of possible illegal actions by the player. When comparing a real time system against a system that is capable of reading all tokens in all bet zones every few seconds (slower than real time) during a game round, the bet differences may not be able to be detected fast enough to allow the detection system to flag undesirable actions by a player of the game.

Bet Monitoring to Detect Cappers

The act of capping is when a player makes a bet or adds to their bet during a no betting period. As an example, a capper may attempt to add to their bet after they look at their cards and determine they have a winning hand. Capping is considered cheating.

As part of bet monitoring, the dealer and the rules of the game may designate periods in each game as betting periods and other times as no betting periods. Thus, during betting periods the players may place bets while during no betting periods the players may not place bets. One of ordinary skill in the art understands game rules and when players are allowed to place bets and thus this aspect is not discussed in detail. By way of example however, in the game of roulette, players may place bets while the ball or the roulette wheel are in motion until the dealer signals that more betting is not allowed by moving their hand around the betting area. Likewise, in blackjack, players may not place bets after dealing has begun. Other games may have similar rules.

In one embodiment, the dealer utilizes the dealer interface to designate a betting or no betting periods. In other embodiment other means may be used to designate betting and no betting periods using a combination of signals from an image based recognition card shoe, bet detection system and game analysis software based on rules of the game being monitored. During play the detection system is continually polling the table and monitoring (detecting which tokens are on the table). If the detection system detects a bet is added to the table during a no betting period, it may generate an alert or other notice to the dealer, a pit supervisor or security personnel. Notice may be visual, audible, or electronically.

In one embodiment the detection system records the bet or wagered tokens on the table at the end of a betting period. During the subsequent no betting period, the detection system continues to monitor the table and detect the tokens that have been wagered. If the tokens detected at the end of the no bet period do not match the number of tokens bet when polling during the no bet period, then it is possible that a player is capping their bet. Accordingly, notice or an alert may be sent to the dealer, security personnel, casino management or even the player.

Bet Monitoring to Detect Pinchers

The act of pinching is when a player removes a bet or decreases their bet during a no betting period. As an example, a pincher may attempt to decrease their bet after they look at their cards and determine they have a losing hand, while in roulette, the player may attempt to remove their bet before the dealer collects the losing bets. Pinching is considered cheating.

As part of bet monitoring, the dealer and the rules of the game may designate periods in each game as betting periods and other times as no betting periods. Thus, during betting periods the players may place bets while during no betting periods the players may not place bets or remove their bet. One of ordinary skill in the art understands game rules and when players are allowed to place bets or remove bets and thus this aspect is not discussed in detail. By way of example however, in the game of roulette, players may not remove or decrease a bet once the dealer signals that no more betting is allowed. Likewise, in blackjack, players may not remove bets or decrease bets after dealing has begun or after the player has seen their cards unless the rules of the game allow a player to surrender or concede further play and thus allowed to remove a portion of the initial bet. Other games may have similar rules.

In one embodiment, the dealer utilizes the dealer interface to designate the betting or no betting periods. In other embodiments, other means may be used to designate betting and no betting periods using a combination of signals from an image based recognition card shoe, bet detection system and game analysis software based on rules of the game being played. During play the detection system may be continually polling the table and monitoring (detecting which tokens are on the table). If the detection system detects a bet is reduced or removed from the table during a no betting period, it may generate an alert or other notice to the dealer, pit supervisor or security personnel. Notice may be visual, audible, or electronical.

In one embodiment the detection system records the bet or wagered tokens on the table at the end of a betting period. During the next or subsequent no betting period, the detection system continues to monitor the table and detect the tokens that have been wagered. If the tokens detected at the end of the no betting period do not match the number of tokens bet when polling during the no bet period, then it is possible that a player is removing or reducing their bet. Accordingly, notice or an alert may be sent to the dealer, pit supervisor, security personnel, or even the player.

Payout Monitoring

In one embodiment, the detection system operates to detect winnings provided to a player. The detection system, configured as described above, detects a wager by a player, such as during a first round of betting. The detection system may also detect supplemental bets by the player. After the round of play is complete, the system may be configured to detect tokens provided from the dealer to the player in the form of winnings. It may be desired to tracking winnings for a player to analyze skill and the overall win or loses from the player over a period of time.

Payouts may be associated with a player in any manner. In one embodiment the tag or identification of the DID token is associated with the player when the player receives the token from the dealer as winnings. In another embodiment the position at which the winning payout is placed is attributed to the player. It is contemplated that the detection system associated with a table polls the table sufficiently rapidly to detect supplemental payout, such as may be made during play of the game but before the end of the game. In one embodiment the table is polled once every two seconds. In one embodiment the detection system polls the table once every second. In one embodiment the detection system polls the table multiple times per second. The term polls or polled the table is defined to mean reading one or more or all of the tokens in one or more or all of the detection zones.

Tracking winnings to accurately associate the amount bet with a player provides the advantage of accurately tracking a player's total amount won and/or loss. This data can be used for numerous purposes. Bet amount tracking data may be used to more accurately compensate players deserving of compensation, such as with free rooms or meals. In one program or embodiment, big losers may be compensated at a greater rate to entice their return. Another reason to accurately track amounts won is to focus appropriate marketing or advertising efforts on the appropriate players.

Payout monitoring may also be performed to detect cappers and pinchers. The acts of capping and pinching are described above and hence not described again. By detecting the initial bet and the ultimate payout, it can be determined if the payout matches the initial bet. If a payout is too large for the initial bet, then capping may be occurring.

By tracking bets, not only are supplemental bets, such as splits and double downs, more accurately detected, but a player's skill level of the monitored game may also be determined. In one embodiment cards dealt to a player are tracked in any manner known in the art. This data may be used to rate the skill level of the player. For example, when a player does not respond to their hand with a supplemental bet when a skilled player would, this may indicate a player of lower skill and thus that player's history is updated to reflect a lower skill level. This allows those in marketing to focus precious resources on those players that have lower skill levels thus reducing their cost in providing free compensation in the form of gifts or comps, or other actions may be taken in response.

Payout Monitoring to Detect Fake Tokens for Cheating/Errors by Dealer

Monitoring of payouts for a winning bet may also detect fake tokens. In some instances, cheater may carefully paint low value tokens to represent high value tokens. In other instances, the tokens may be illegally manufactured to appear as tokens, when in reality they were not purchased from the casino for play. Regardless of how the tokens are created, if a bet is detected or not detected at all, yet a payout is made to the player that does not reflect an accurate payout for that bet then a fake token may be in use. Likewise, if a payout is made to a player who did not bet, then a fake token may be in use which does not provide a DID signal.

In addition to detecting fake or forged tokens, cheating or error by the dealer may also be detected. By way of example, a small percentage of dealers may make an error with regard to a payout amount. By detecting the amount bet and the amount paid out then the detection system may detect when a payout is greater than or less than the possible correct payout amounts. Upon detecting an incorrect payout amount, an alert may be provided to the dealer, pit boss, or other personnel.

In the case of cheating, a dealer may operate in collusion with a player to pay out more than should be awarded for a winning hand. Alternatively, the dealer may payout less than should be awarded for a winning hand in hopes of keeping the difference. In one embodiment the detection system may be configured to monitor such incorrect payout amounts to detect such cheating. Operation is similar as described above for dealer errors.

It is further contemplated for all embodiments or configuration shown or described therein the detection system may operate in connection with a card shoe reader or other card reader mechanism. Such a card reading system is capable of providing input to the detection system or other software or computer regarding which cards were dealt to a particular player. As a result, when a player receives a particular winning hand, the wager or payout detection capability may compare the payout to the wager and the actual hand dealt to the player to calculate the proper payout. This would prevent the dealer from secretly providing a payout to a losing hand. Moreover, accuracy may be maintained by providing the appropriate payout based on the hand. As is understood, in certain games, certain hands or cards generate an increased payout. Although this principle may apply to any game, in the case of blackjack, a blackjack hand (ace and a 10 card) would result in a higher payout than simply beating the dealer's hand without a blackjack hand. This detection system could accurately detect a proper or improper payout made to a blackjack hand or a winning event in another game.

In the case of a losing hand, which is known to be a losing hand based on the card reader system, no payout should be made and hence any payout to a losing hand would generate an alert.

Host Compensation and Rebate Program Tracking

Figure 6:
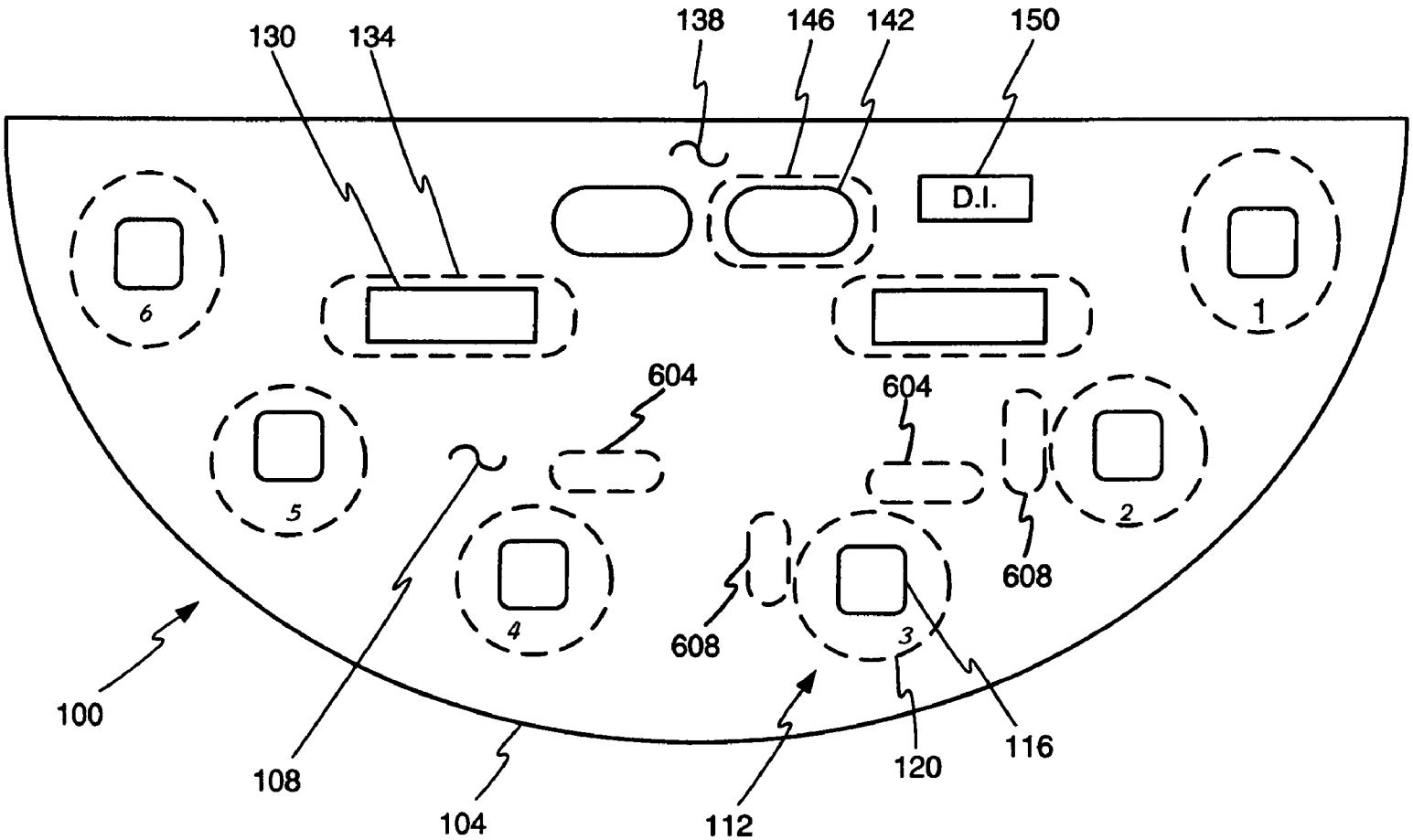
FIG. 6 illustrates a top plan view of an example embodiment of a table with supplemental token detection locations.

FIG. 6 illustrates a top plan view of an example embodiment of a table for use with a table game. Similar to FIG. 1—Payouts or supplemental bet zones may be provided in addition to the bet zone or detection zones described above in connection with FIG. 1. These additional bet zones provide additional levels of accuracy when detecting payouts or supplemental bets. In this example embodiment a payout zone 604 is associated with one or more player positions. The payout zone may comprise an area or location on the table where payouts are made to the player. A separate DID reader may be associated with the payout zone 604. By making payouts in a different location and being detected by a different DID reader, the detection system may more accurately track and differentiate payouts as compared to wagers.

A supplemental bet zone 608 may be associated with one or more player positions to provide additional levels of accuracy when detecting payouts or supplemental bets. In this example embodiment a supplemental bet zone 608 is associated with one or more player positions as shown. The supplemental bet zone 608 may comprise an area or location on the table where payouts are made to the player. A separate DID reader may be associated with the supplemental bet zone 608. By placing supplemental bets in a different location and being detected by a different DID reader, the detection system may more accurately track and differentiate supplemental bets as compared to standard wagers.

Token Tray

As shown in FIG. 5 a token tray may be included in the detection system. In prior art methods of operation, token trays were not DID compatible and as a result, counting down a token tray filled with tokens was a time consuming and challenging task. Furthermore, because tokens are counted by the dealer or another individual, counting mistakes or intentional miscounting may occur. In some instances, the token tray may contain a hundred or more tokens. To overcome this drawback in the art, the token tray may be equipped to detect the tokens stored therein. This total token value may be provided to the detection system or an itemized list may be generated of each token and the identification number for each token. It is further contemplated that the token tray may be utilized in the casino cage so that tokens may be logged out and automatically counted by the dealer and likewise accepted and automatically counted at the cage. Over the course of a year, the accuracy and time saving realized by DID detectable token tray will provide efficiency and cost savings to a casino or other gaming entity.

Token Tray and Cross Tracking of Tokens

In addition, polling of the token tray may occur to track a payout to a player or tokens in general. By tracking tokens from one authorized location to another authorized location, tokens may be tracked and misplacement of tokens or theft may be reduced.

In one example embodiment the token tray with DID detection and the detection system detect a token as the token leaves the token tray and is provided to a player to reward a winning wager. In another instance, the token may leave the token tray to exchange tokens of one value with tokens of another value. Token movement may likewise be tracked. In the event that a token leaves the token tray but is not provided to a player, which would be revealed to the table detection system, then the token may be misplaced or inappropriately taken by a player or dealer.

Token Tray to Detect Fake or Non-Functioning Tokens

It is also contemplate an automatic DID type count of a token tray may be reconciled with a visual count of the tray to detect fake tokens. In one embodiment, a visual count may reveal a greater value of tokens than that detected by an automated count of the tokens in the tray. In such an event, some of the tokens may be encoded with a lower DID value than the token appears to represent through visual inspection. This may reveal a fake token or a forged token, modified to look like a high value token. In addition, it is also contemplated that the DID electronics or antenna within a DID token may break or become inoperable. In such an event, the inoperable token will not reveal itself or be detected by the reader of the DID capable token tray and as such, the automatic count may generate a total token value that is less than the visual count.

Token Tray to Verify Bet Paid Properly

It is further contemplated that using the method and apparatus described herein that payouts may be monitored by polling the bet tray to detect changes in the value or DID tokens located in the bet tray. Likewise, the amount collected on losing bets may also be tracked by polling the bet tray during play or after a round of betting/bet collation.

In one example method, it is contemplated that after a round of paying out winning bets and collecting losing bets that the token tray may be polled to determine the change in value to the token tray. This data may be utilized alone to maintain a running token tray total or compared to other data. For example, the token tray data may be compared to the data regarding cards dealt to each player to determine which hands were winning hands and which were losing hands, and the payout amount for each hand. Based on this comparison, a conclusion regarding the accuracy of the payouts and bets collected may be arrived at and reported. Alternatively, if the bets and payouts are monitored on the table, in addition to the token tray, than the bets and payouts may be compared to the value of the DID tokens in the token tray to determine if the payouts are correct and/or the collections are correct. In one embodiment the errors may be determined immediately while in another embodiment the errors or the potential for errors or cheating are tracked or detected over time.

Tracking Drop Based on or During Buy-In (7)

In one embodiment the system may be utilized to track drop based on buy in. For example, if a player arrives at a table to initiate play at the table, the player will often provide the dealer with money. The money is usually placed on the table, and collected from the table by the dealer and exchanged for chips or tokens. During this process the dealer verbally calls out the amount of money provided by the player. Upon hearing the call out, a pit boss or other personal should record the amount. Thereafter, the appropriate value of tokens is provided to the player and the money is deposited in a cash box, via a table top slot or opening. An overhead camera records the cash placed on the table and the chips which are provided to the player.

This amount of money is often referred to the drop, and the drop may be sub-divided by table, shift, or day. At various times, such as at the end of a shift, a comparison may occur between the amount of money actually in the cash box and that recorded by the pit boss as a result of the call-outs. Likewise, the cameras may be monitored to verify that the token value amount provided to the player corresponds to the amount of cash provided by the player.

Collectively, these rather cumbersome operations are executed primarily to prevent theft and mistake, either of which may result in loss to the casino or the player. These operations may also be performed to track profit and play patterns. This information may be useful for casino monitoring or management.

As can be appreciated, this method of drop tracking is slow, subject to mistake, and capable of bypass. In addition, this method of security and drop tracking requires numerous human resources to monitor cameras, record verbal drop call-outs and enter call-outs into computers or hard copy.

To overcome the drawbacks associated with these methods and provide additional advantages and benefits, a method of buy-in at a table to exchange money for tokens is disclosed. In one embodiment, DID tokens are utilized, such as described above, and in such and embodiment the dealer would place the tokens on a particular location on the table capable of detecting the value and/or identification of the tokens. In reference to FIG. 6, the dealer may provide the tokens on to a buy-in detection zone 604, if so configured, that the token placed in this buy-in detection zone 604 would be counted by an antenna associated with the buy-in detection zone. This value would then be recorded as a buy-in amount for that table or player at a computer associated with the table or computer or other processing devices shared by multiple tables. These computers or processing devices may be networked.

This buy-in amount may be reconciled against amounts verbally provided to a pit boss or the amount of cash deposited to the cash box may be tracked, such as with a bill counter/validator. In such an embodiment the token value detected by the detection system when the tokens are placed in the buy-in zone would be recorded and stored in a computer. In one embodiment this computer is accessible by the pit boss and, as a result, this process of automatic token detection eliminates the need for the dealer to verbally call out the buy-in amount and for the pit boss to hear and physically enter the amount in to the computer. In addition to reducing the likelihood of a mistake or a missed buy-in call out, this method frees the pit boss for more important duties.

In addition, this method also eliminated the risk of mistake or deception by the dealer when making a buy-in call out because the detection system automatically and accurately detects the amount provided to the player when the tokens are placed in the buy-in detection zone 604. Utilizing the procedure described above, an antenna or other energy radiating element activates the one or more DID tokens provided in the buy-in detection zone 604. As a result of the automated and electronic detection, the amount provided to the player is accurately detected and mistakes by the dealer will be detected as will potential deception or cheating by a player-dealer team.

In one embodiment, the tokens provided to the player during a buy-in may be placed at any table location for detection so long as that table location is associated with a detection zone, and the detection performed by that detection zone is read and associated with a buy-in operation. In one embodiment, the dealer interface, shown in FIG. 2, may be configured, such as with a button or key, to indicate to the detection system when a buy-in is occurring. Accordingly, using such a system, the dealer may press the button or in any way indicate to the detection system that a buy-in is occurring and the detection system will assign the amounted detected, in the predetermined buy-in location, which may or may not comprise location 604, as a buy-in amount. This buy in amount may optionally be attributed to a player, the player position, or both.

Alternatively, the dealer may utilize a buy-in token in connection with tokens provided to the player as part of the buy-in. The buy-in token may comprise a token configured with a particular identification that designates the token as a buy-in token. When the buy-in token is provided to the player with other tokens, the detection system recognizes the buy-in token and thereby attributes the tokens provided to player as part of a buy-in. The dealer may optionally retrieve the buy-in token from the player after the buy-in is complete.

In one embodiment, a single buy-in location is provided near or for the dealer. This spot on the table may be known as a dealer buy-in location. In such an embodiment, the dealer may provide or place the buy-in amount on the dealer buy-in location and utilized the dealer interface to designate which player is to receive the buy-in amount, i.e. which player will receive the tokens. For example, the dealer may place the tokens on a dealer buy-in location and designate to the dealer interface which player position the tokens will be provided. This method provides an alternative method of providing tokens to a player while tracking buy-in. In FIG. 6, locations 142, 146 may comprise dealer buy-in locations and the dealer interface may be configured to accept input to indicate a buy-in.

It is further contemplated that tokens taken from the token tray, as shown in FIG. 5 may be tracked to a particular buy-in detection zone, such as detection zone 604 as shown in FIG. 6. As a result, the amount or value taken from the token tray is tracked to a player position and the identification code and/or other token information is also tracked and associated with a player position. This provides the benefit of insuring that the tokens and the token value taken from the token tray are quickly and faithfully provided to the player or at least provide and logged by the buy-in detection zone. This prevents or will detect if the dealer, mistakenly or intentionally, attempts to take a first value of tokens from the tray but only provide a lesser value of tokens to player, such as by keeping one or more of the tokens. This also provides accurate tracking to prevent or detect a player from asserting that they were not provided full value for the buy-in money they provided. For example, if a player claims to have been cheated, the detection system will have recorded the token value taken from the token tray and provided to the player at the token detection zone. The mere presence of this system will discourage cheating. Furthermore, images captured by overhead cameras may also be consulted, but the detection system provides a faster, more efficient detection system without having to resort to cameras and security personal located separate from the gaming area.

Figure 7:
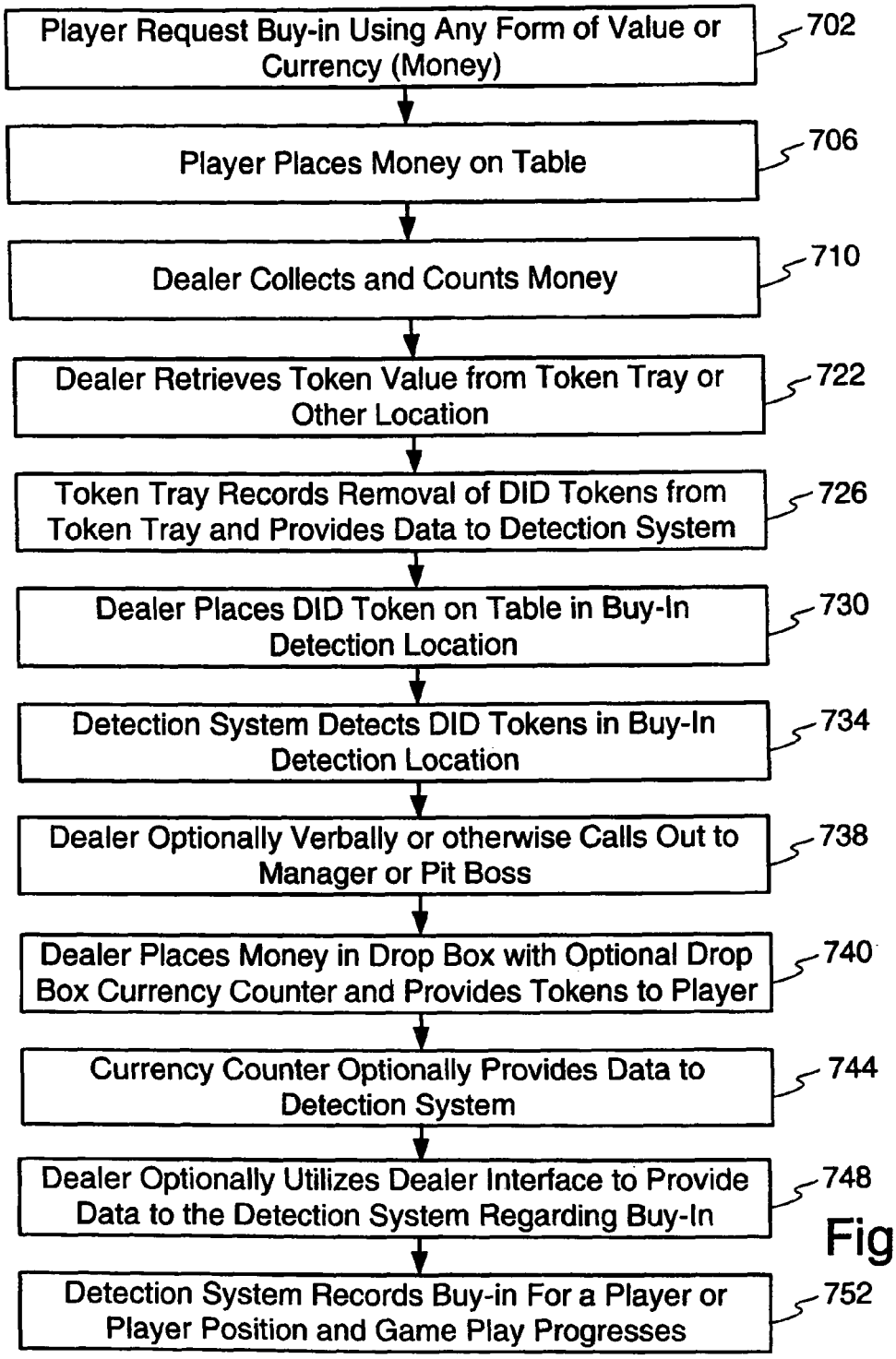

FIG. 7 illustrates an operational flow diagram of one example method of operation for tracking player buy-in. This is but one possible method of operation and as such, other methods are contemplated. At a step 702, the player may request a buy-in using any form of value. In this embodiment the player presents currency or money for exchange for tokens. In this embodiment DID tokens are utilized. At a step 706 the player places money on the table and at step 710 the dealer collects and counts the money.

At a step 722, the dealer may retrieve DID tokens from the token tray or other location. It is contemplated that the token tray may comprise a token tray capable or reading DID tokens stored therein. One example embodiment of a DID token tray comprises the tray shown in FIG. 5. At a step 726, the token tray may record the removal of DID tokens from the token tray and provide the data to the detection system. This data may comprise token value and token ID. This may occur as described herein or in any manner as would be understood in the art.

Next, at a step 730 the dealer places the DID tokens taken from the token tray in a buy-in detection zone location on the table. This may occur in any manner or at any location on the table as described herein or equivalents thereto. When placed on the table, the detection system, at a step 734 detects the tokens and may optionally detect a buy-in token.

At a step 738, the dealer optionally verbally or otherwise calls out to the manager, pit boss, or other party record the transaction of visual observe the transaction. At a step 740 the dealer places the money in a drop box for storing money and provides the tokens to the player. An optional drop box currency counter may be associated with the drop box and configured to count the money places into the drop box. If so equipped, at a step 744 the currency counter may provide data regarding the amount of currency deposited therein to the detection system.

The dealer, at a step 748, may utilize the dealer interface to provide input to the detection system regarding which player received the tokens or will receive the tokens. As used herein, the term player may also be used to refer to player position. In other embodiments the dealer may use the dealer interface to instruct the detection system which player position received or will receive the tokens. At a step 752, the detection system interrogates the DID tokens to receive the DID token data from the tokens placed on the table, at any designed token buy-in location. The detection system may have optionally received data from the dealer interface, depending on the particular configuration of the detection buy-in system. At this stage, the detection system has the information regarding the DID tokens and which player position or player received the DID tokens. The detection system may also receive input from the currency counter associated with the drop box and data regarding DID tokens that left the token tray. This system and method of operation provides numerous advantages to the gaming establishment as described herein.

It is further contemplated that the token detection system as described herein may be used to monitor a check change operation, which comprises the exchange of token, by a player, at a table or other location, for tokens of other denominations. In such an operation the player would present tokens of one denomination for exchange. The monitoring system may detect the value of the tokens, such as placed on the table, and verify the tokens are authentic and of the represented value. Likewise, the detection system may also monitor the outgoing tokens. Use of the monitoring system in this manner reduce errors and prevents counterfeit tokens from being introduced and accepted. It is contemplated that one or more antenna may be utilized for this operation.

Player Recognition and Drop Association (8)

In a similar manner to that described above for buy-in, a player may also be logged into a player tracking system or detection system using DID technology. In casinos and gaming environments, it is often beneficial and desired to maintain and associate an account with a player. In numerous different variations, the player may be tracked, monitored, and rewarded based on the player account and the player data and player history may likewise be associated with the player account.

For slot machines, which are popular gaming apparatus in casinos, players are often issued a player tracking card having a magnetic strip attached to the back side of the card. The magnetic strip is magnetized to contain player information thereby providing the player data on the player card. The slot machine is equipped with a magnetic strip reader so that the player may insert the card into a slot machine to identify themselves to the slot machine and the player tracking system. While this system works for slot machines, it suffers from numerous disadvantages, many of which are simply unacceptable in a table game environment.

One such disadvantage is that players must carry with them an additional card. This means that a player must bring the casino issued card with them every time they want to use it during game play and must maintain the card in a reasonable manner to avoid erasure of the data. Failure to bring the card may lead to non-use of the card or a decision to not gamble. Exposure of the card to a magnetic field or scratches on the magnetic strip will lead to unwanted failure. In addition, table gaming, as opposed to a slot gaming, is often considered sophisticated and glamorous. This image does not always lend itself to use of a plastic card, such as used by a slot player.

Another drawback associated with use of a magnetic strip device to identify a player at a table is that expensive magnetic strip card readers must be added to each table to read the cards. This requires power, additional interface circuitry, and, if a player is to log in themselves, than a card reader must be associated with each player position. If a card reader is to be shared, such as for use by a dealer, then game play will be slowed due to the dealer having to stop game play to run player cards through the magnetic strip reader.

To overcome these drawbacks and provide additional benefits, a method and apparatus is disclosed for logging in and/or tracking a player at a gaming table or game event other than a slot or poker machine. One such method of player tracking is to associate a DID element with a player. The term associate is used broadly here to mean that unlike the "card" type tracking card that utilized a magnetic stripe a DID element may be placed in or on any type device and the device with the DID element is programmed with data that associated that DID with the player, such as by name or numeric code. It is also contemplated that any data from a DID token, such as serial number or token amount, can be written to the player card DID as another method to associate DID tokens with the player's account.

Figure 10:
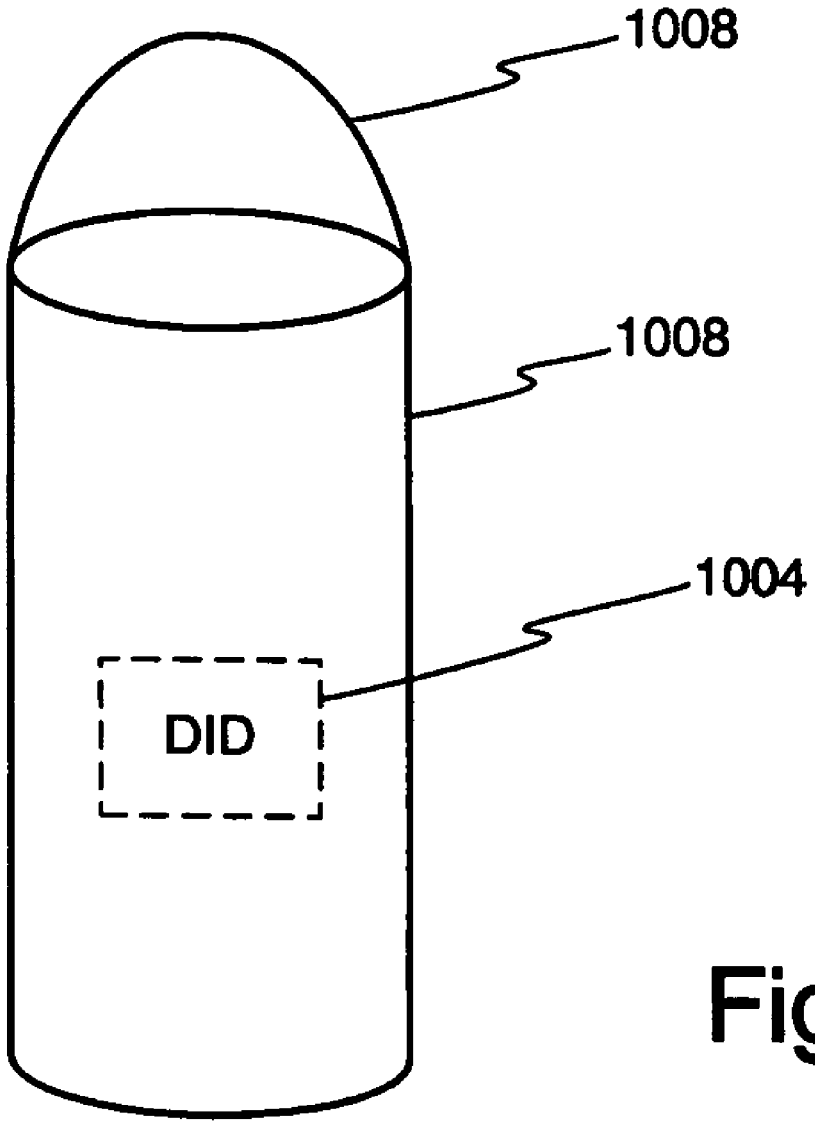
FIG. 10 illustrates an example embodiment of a player DID.

FIG. 10 illustrates an example embodiment of a player DID (player tracking DID). In this example embodiment, a DID device 1004 is housed within a decorative and protective housing 1008 which has a loop 1012 located at one end. The loop 1012 may be used to secure the player DID to a key chain or other element that is carried by a player. In other embodiment the housing 1008 may be flat to fit in a bracelet, wallet, or other element that is with the player.

In one embodiment the DID element may be thin and thus stuck to a flat surface such as one a card or key. The DID element may also be embedded directly in the player identification device. The devices, with which a DID element may be associated include, but are not limited to a card, key chain, jewelry item, watch, such as on the back of a watch, into a wallet, as part of a bracelet, into or part of a purse, into a player tracking card (with or without a magnetic strip), money clip, room key, under the skin, on or part of glasses, back of a credit card, drivers license, smartcards, or other item or card type element. As a result of the numerous ways to store or house the DID element, it is more likely a player will have the DID element at the table. The term DID element is defined to mean any DID device that is capable of being detected by a detection system, such as the detection system described herein. Any type technology may be used to detect the DID element.

In operation, the DID element, regardless of how it is housed or contained is placed on or near the table or other detection device and interrogated by the detection system described herein. The table may be equipped with a dedicated player DID element detection zone, such as element 608 in shown in FIG. 6. This zone may be labeled as a player log-in or player detection zone. Alternatively, the player may place the player DID element on the player betting area or other area associated with the player position either at the start of play, during play, at the end of play, or any combination thereof, to "log-in" with the detection system. As a result, the detection system will read the player DID element, and associate the player with that player position and log game play to that player. In one embodiment, a player may be rewarded with additional compensation for extended play or token turn-over. The player tracking system for use with a table game or other game environment provides accurate, rapid, and sophisticated player tracking. The player DID element read and recognition process, as performed by the detection system, is generally similar to the DID token detection and read process as described above and hence is not described in detail again.

A further benefit of this method of detection is that forgery or copying of DID elements is very difficult and hence cheating or false player identification will be minimized. Magnetic strip reproduction may more easily be performed than DID counterfeiting, and hence use of magnetic strips may not be considered a secure identification means.

In another embodiment the player may provide the card or other player DID element to the dealer, pit boss, or other casino personal (hereinafter dealer) and the dealer may log in the player by placing the player DID element, at or near a reader for the detection system or a reader associated with a DID element reading system other than the detection system. The dealer may also associate the player with a player position. Thereafter, the dealer may keep the card, until the player stops playing, or return the player DID element after logging the player in to the game and a player position. This method of tracking a player or logging in a player will reduce the time it takes for a dealer or pit boss to log-in a player, thereby freeing that individual for other tasks including providing the game to the players.

During game play and as discussed above, association of the player to a player position automatically attributes player drop, winnings, amount lost, and/or other relevant information to that player. It is contemplated that in one embodiment, this data or at least some data, is automatically written back to the player tracking DID element and store thereon. In this manner, the player tracking DID may contain data regarding game play or other data that is updated during game play. In one embodiment, the player may leave the player DID at or within a detection zone at the table during game play. Thus, as long as the player leaves the player DID at a designated spot at the player position, then the tracking system will associate the player with that position and log the player into the tracking system.

It is further contemplated that the player tracking DID element may be used at other than a game table, such as for example to assist in dining, event, or shopping activities. For example, if a player, as evidenced by the DID element used during game play, was a big winner, loser, or long term player, then non-monetary compensation (comps) may be available to the player. In such a case the player may simply present the card to the restaurant, event manager, or shopping clerk and be provided with comps. In addition, the player may present their player DID during such activities to build appreciation or comps with the casino or resort (property). Such dining, event, and shopping using the player DID may build player points or other awards.

Property Monitoring and Associated Patron Identification (9)

It is also contemplated that a player, having a player tracking device which accompanies the player, may also move about the resort property or casino (hereinafter property). As such, the player or customer, via the player tracking DID which accompanies the player, may be monitored as the player moves about the property. This may provide numerous benefits to the property personal and the player, i.e. customer. It is also contemplated that DID tokens that are with the player, other individuals, or locations, may also be monitored.

Figure 8:
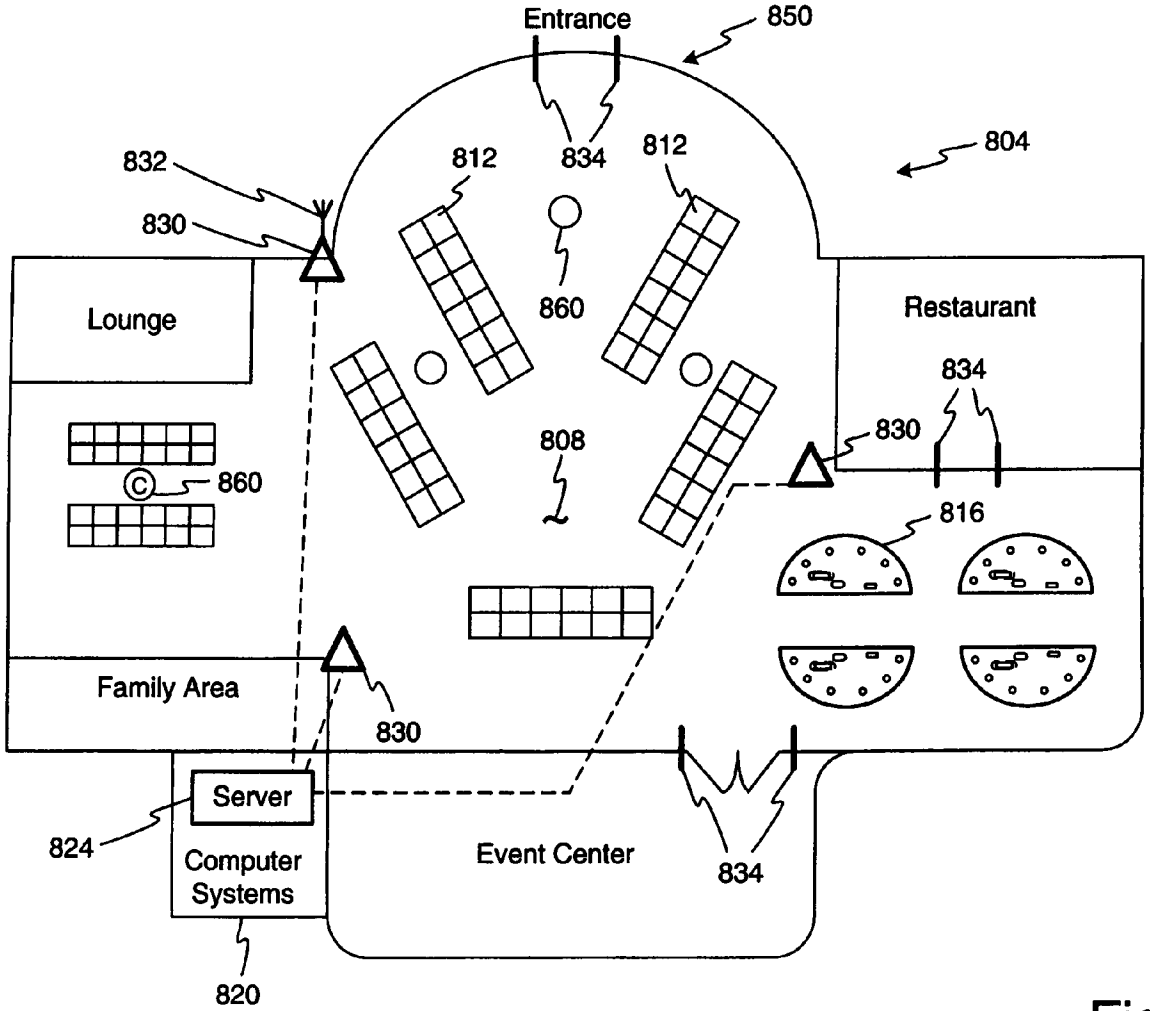
FIG. 8 illustrates an example embodiment of a property configured with DID tracking capability.

FIG. 8 illustrates an example embodiment of a property configured with DID tracking capability. In this example embodiment the property 804 may comprise many different locations, such as but not limited to, a casino area 808, with gaming tables 816 and gaming machines 812, a lounge, family area, restaurant, and event center. The property 804 may also be configured with one or more computer systems 820 such as a server 824 configured to interface with one or more detection devices. In this embodiment the detection devices are configured as overhead detection devices 830 and entry way detection devices 834. In other embodiments, other types of detection elements may be utilized.

As shown, an overhead detection device 830 may be equipped with an antenna 832 and communicate with a tracking system server 824 via a communication link. The entry way detection devices 834 may be selectively placed at any location within or about the property to detect a player tracking DID as the player moves from one location to another. In one embodiment an entry way detection device 834 may be located at an entrance 850 to the property to thereby detect players entering the property. This detection, and others described herein, may be combined with detection of the value of or number of DID tokens with the player. Thus, the player's name or personal information may be provided to a host or hostess for personalized services, or a player with a large amount of money in the form of DID tokens, which is detected by the detection system, maybe greeted by the pit boss and encouraged to play, given a seat at special gaming table, or asked to pay an outstanding debt.

The entry way detection devices 834 may also be located near an entrance to a restaurant or event centers so that certain players may be assigned a greater level or service or security. Although not shown, it is contemplated that the entry way detection devices 834 may also communicate with the server 824. For example, a player may be greeted by name or if a large number of tokens are detected, then the player may be provided a guard or greater surveillance coverage.

It is also contemplated that overhead detection devices 830 may be placed throughout the property to monitor for DID based player tracking or token elements. Using overhead based tracking may provide greater coverage for the property thereby expanding the scope and benefits.

In one embodiment the identification data associated with the DID token may be read as the DID token enters the property or casino. In this manner identification of stolen, expired, or fraudulently obtain DID tokens may be identified as they enter to property. The tokens may be confiscated and the individual with the tokens questioned or the tokens may be exchanged for valid tokens.

It is also contemplated that the detection devices 830, 834 may be provided near the gaming tables 816 or slots 808 to identify players as they enter the gaming area. As a result, players may be identified and located more easily or special players provided special treatment. Some casinos worldwide have separate gaming areas that are classified by the amount of money the players usually gamble. By monitoring entry ways to all gaming areas, entry can be controlled using the player DID as the key for entry along with monitoring and triggering an event after detection of any player DID not authorized to enter particular gaming areas or unauthorized areas.

Using the player tracking and DID detection system described herein, it is also contemplated that one or more cameras 860 may be utilized to more accurately identify players. The tracking system described herein may be configured to interface with the cameras, such as a closed circuit television or camera system. In one embodiment biometrics may be utilized in addition to player tracking and camera monitoring to more accurately identified players initially detected by the DID based tracking system. In one embodiment, a player with large number of DID tokens, may be identified by the camera, and biometrics used to associate a name with the player. Then the picture and player information, if available, may be sent to employees on the floor, who may locate the player and behave accordingly, such as with a greeting and invitation to play.

In one embodiment, problem or addicted gamblers may be identified if they have a player tracking DID card and thus they may be prevented from gaming. Likewise, players with large debts may be identified as soon as they enter the property or even if they move to another table or location in the property. In addition, a high roller or a 'whale' player may be identified and tracked as they move through the casino to thereby the best customer service, incentives or opportunities to gamble.

It is also contemplated that the detection system, such as that enabled by detector 830, 834 may be utilized to track property employees and/or DID tokens in the possession of property employees. In one embodiment all property employees or personal may be equipped with a tracking device. The tracking system may be used track employees to more effectively manage and monitor employees. By way of example, security employees may be monitored to obtain proper coverage over the property to provide maximum security. Cocktail waitress may be monitored to insure all areas of the gaming area are being served. Employees who leave their posts or take excessive breaks may be monitored. It would also be possible to monitor which employee performs the most rounds or was at a particular location, to thereby reward good employee conduct.

It is also possible to monitor employees who have DID tokens with them, such as in the rare event of theft by an employees. A player with DID tokens can be monitored as the DID token moves with the employee through the property. Detectors 834, 830 may also be located in the employee only areas of the property, such as employee entrances, locker rooms, eating areas, break areas, and the like.

As a summary of the concepts listed above, an example embodiment would place antennas at doors to detect casino DID tokens or player DID device on a person. This would provide the benefit of allowing the value of the tokens to be read as a person enters or leaves and the tokens' unique serial identification can be read to determine if the DID tokens are stolen or expired. This coupled with a player tracking system using player DID will allow the casino to know the identity of the person that is carrying the tokens. This information can be logged and also written across CCTV systems via an interface to marry the data with the images. It could also detect employee theft and collusion.

In addition, the player tracking DID on a person can also alert a casino of where a patron may be on their property. For instance, having antennas at the entrance of a high limit area could alert the casino staff that a player is entering to provide better customer service. It might also alert security of a patron that has been kick-out of the property or has self-excluded for problem gaming reasons. In addition, this same system may also be used for employees to detect who is where and what doors they have passed through.

Figure 9:
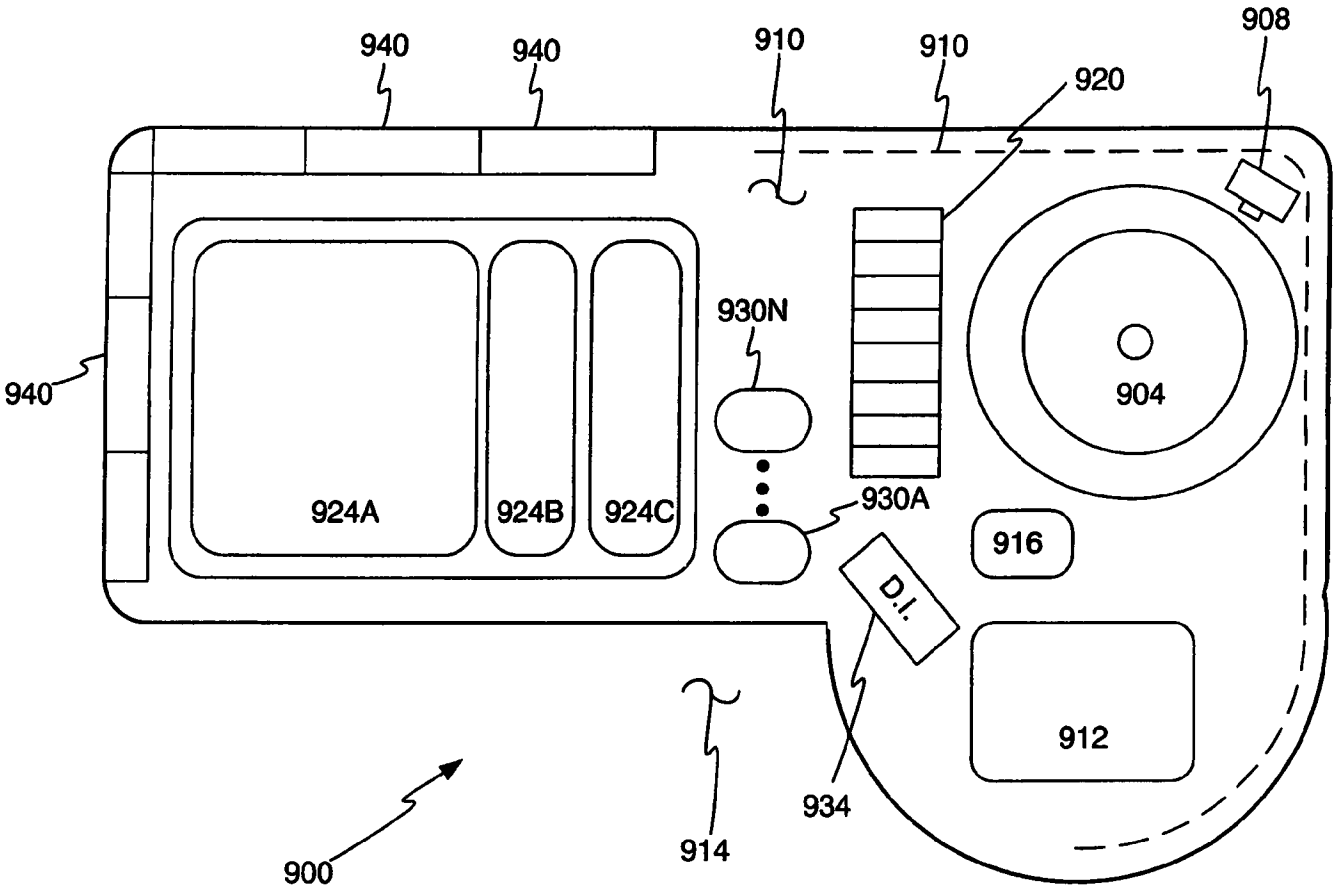
FIG. 9 illustrates an example of a roulette table configured with one or more antenna and reader to monitor DID elements placed thereon.

FIG. 9 illustrates a top plan view of an example embodiment of a roulette table equipped with a table monitoring capability. The roulette table monitoring capability, functionality, and associated systems and elements as described herein is generally similar to that described above in connection with FIGS. 1-8 and as such, a duplicate discussion is not provided. The features, elements, functionality, methods of operation, associated systems, tokens, and options that are described above are hereby incorporated into the roulette table as shown in FIG. 9. It is contemplated that one of ordinary skill in the art would be able to configure the elements and features as taught above in FIG. 1-8 into the roulette table of FIG. 9. For example, one or more antenna is associated with the table and the one or more antenna may be utilized to energize one or more DID elements, such as checks, to thereby cause the one or more checks to emit a signal. The one or more antenna may receive and read the signal from the check and forward this signal/information/data to a computer or other device associated with the table monitoring system.

As shown in FIG. 9, the roulette table 900 include upper surface 902 on which a wheel or outcome generating device or element may reside. In this embodiment a roulette wheel 904 is provided and monitored by a camera 908. The camera may record the slot location of the ball and which indicia are associated with the slot. Thus, the camera 908 may record and/or display the outcome of the roulette wheel 904. The camera 908 may provide the outcome information to the monitoring system.

As is understood, the wheel 904 has numerous slots into which a ball may rest after the wheel and ball are spun. The slots are associated with numbers, or other indicia, which generate, depending on the location of the ball, the outcomes. In one embodiment, more than one indicia may be associated with each slot. A security barrier 910 may be present around the wheel and checks.

A token or check storage area 912 is provided for storage of any type of check. The term check and token maybe utilized herein interchangeable. It is contemplated that the checks contain DID elements. FIG. 3 illustrates an example check. One or more checks may be stored in the storage tray 912 for use during play of the game. The tray may comprise a tray shown in FIG. 5. A supplemental storage area 916, such as for storage of additional balls, markers, dollies, or any other element is also provided. It is contemplated that the check storage tray 912, the supplemental storage area 916, and the wheel 904 are easily accessible by the dealer, who may be located in area 914.

It is contemplated that one or more of the wheel 904, check storage tray 912, and supplemental storage area 916 may be enabled for monitoring and connected to the monitoring system. In one embodiment the elements 904, 912, 916 include or comprise one or more antenna configured to communicate with or detect checks, balls, dollies, markers, or any other DID equipped element. In one embodiment a DID element comprises a RFID (radio frequency identification) element contained within the ball, token, check, dolly, marker or other element.

Also shown on the table 900 in FIG. 9 is an association area 920 which maybe utilized to associate one aspect of table play to another. In one example embodiment, the association area 920 is enabled for monitoring and connected to the monitoring system. One or more antenna may be associated with the association area 920 to monitor DID equipped elements within the association area. It is contemplated that the association area 920 may be configured with one or more sub-sections which may individually monitored thereby allowing the monitoring system to distinguish between different items in different sub-sections. The sub-sections may have different or unique designations. An input to the monitoring system from the one or more antenna and readers that are associated with the association area 920 may provide information regarding the associations intended by arranging certain DID equipped elements on the association area. This is discussed in greater detail below.

Also part of the table 900 is one or more betting areas 924. The betting areas may be divided into sub-areas 924A, 924B, 924C configured to accept bets on different outcomes. As is understood in roulette, there are multiple different possible outcomes depending on the set up of the wheel 904 and hence it is contemplated that the betting areas 924 may provide opportunity to bet on any possible wheel outcome or combination thereof.

It is contemplated that the betting area 924 may be monitored by the monitoring system and the results of the monitoring provided to the monitoring system. In one embodiment, a single antenna is located near the betting area to monitor placement of DID elements on the betting area. As described herein and as may be possible for all the embodiments described herein information stored on the check, marker, token, dolly or other DID element placed on the betting area 924 or any monitored area of the table is capable of being read from the DID element or written to the DID element by the monitoring system. The monitoring system may be configured similarly to that shown in FIG. 4.

In one embodiment the antenna associated with the betting area 924 or any other area of the table may overlap to insure accurate and reliable reading of the DID elements. In one embodiment three partially overlapping antenna are utilized to read the betting area 924. In one embodiment one or more antenna are associated with each betting spot of the betting area 924 thereby allowing for detection of every bet on every unique bet. The possible bets on the betting area may include, but are not limited to, the following bets: straight bets, split bet, street bet, corner bet, line bet, column bet, dozen bet, even bet, inside bet, five number bet, inside bet, outside bet, red bet, odd bet, black bet, even bet, zero bet, column bet, row bet, or any other bet or combination. It is contemplated that the monitoring matrix create by the antenna associated with the betting area 924 may possess any level of resolution and hence, any one or more bets may be monitored and detected. In one embodiment one or more of the bet areas are configured as progressive bet areas used to place progressive bets. In one embodiment the bet areas 924A, 924B, 924C are spaced apart to aid in the accuracy reading of DID elements.

In another area of the table 900 are one or more various DID element detection areas 930A through 930N where N may comprise any whole number. These detection areas 930 may be configured for any type use or function. A dealer interface 934 may also be provided. The dealer interface 934 comprises a device through which the dealer may provide input to the table monitoring system or received information from the table monitoring system or the table directly.

In one embodiment one or more of the detection areas 930 are configured as buy-in zones, which is described below in more detail. In one embodiment the detection zone 930 may be configured as pay-out zone. In one embodiment, the detection areas 930 may be configured as check change zones.

In one embodiment the dealer interface 934 may be utilized to operate in connection with one or more other detection areas on the table or any other aspect of the table monitoring system. In one embodiment the dealer interface 934 may be utilized by the dealer to designate to the monitoring system one of the detection areas 930 for a particular purpose for any period of time. In one embodiment the dealer interface 934 includes one or more buttons, switches, touch screen, keys, or any other user interface that allows the dealer to designate a particular purpose for one or more of the areas 930. For example, detection area 930A may comprise a buy in detection area when a player is buying checks but at another time, as designated by the dealer via the dealer interface, serve as a check change detection area or a pay-out detection area.

In this example embodiment of the table 900 one or more player check or token storage areas 940 may be located at the outer edge or other location of the table. It is contemplated that these areas 940 may be configured as detection zones and monitored by the monitoring system. In this manner, the monitoring system may detect and track checks possessed by the player(s).

Operation

Various examples of operation of the table and associated monitoring system are now described in connection with one or more outcomes on the wheel. These methods and the above described apparatus and configurations may be combined in any combination or enabled alone. This is but one possible example method of operation of a round of roulette and as such it is contemplated that in other embodiments other method of operation, features, and benefits for the monitoring system may be utilized based on the teachings contained herein.

At a step 1100 the player may arrive at a table that is equipped with or to perform any of the following: monitoring of DID elements, tokens, roulette balls, tokens, checks, dolly, marker, betting area, check storage area, supplemental storage area, tray, detection area, dealer interface or any other element. At a step 1104 the operation may comprise differing methods of operation depending on which type of checks are in use, namely, wheel checks or value checks. Both may be used, in which case both paths would be followed. In this example embodiment, wheel checks comprise tokens that are assigned a value by the dealer and that value may change depending on the assignment by the dealer. In contrast, value checks comprise tokens which are assigned a predetermined value and the value does not change.

According, if at step 1104 the operation determines that wheel checks are to be utilized, then the operation advances to step 1106, which is a jump point to FIG. 11D, which is discussed below. Alternatively, if value checks are to be used, then the operation advances to step 1108 wherein the dealer may log a player into the table monitoring system, player tracking system, or any other means to track the player at the table and the amount wagered (won, wagered, lost, or combination thereof). In one embodiment the association area is used to log a player into the table by placing a DID equipped player element, such as a player tracking card, on or near the association area. The monitoring system will detection the DID element in the player element and log the player into play at the table. In another embodiment the supplemental detection area may be used with or without assistance from the dealer interface.

At a step 1110, if the player does not arrive at the table with existing value checks, then the player may buy in to obtain value checks for betting. In this embodiment the player places money or other form of value on the table and at a step 1112, the dealer removes a corresponding amount of value checks from the tray. The table monitoring system would detect the removal of value checks, and some or all information associated with the checks, from the tray. The dealer may either give the checks directly to the player or place the checks on a detection area, such as a detection area which may be used as a buy in detection area. The dealer interface may designate a detection area for a special use such as the supplemental area, to perform the buy in operation. It is contemplated that the dealer may involve a pit boss or other supervisor to monitor the buy in process and call out the drop to the table. In one embodiment a drop box may be used which detections the drop and reports the drop electronically to the monitoring system. In this manner, the monitoring system may detect the amount or value of the checks removed from the tray and verify, via the detection zone on the table that the checks are provided to the player and that the amount given matches the amount taken from the tray. This information may also be associated with the player.

At a step 1114, the dealer may designate a detection area, using the dealer interface, as a buy in zone and by placing the checks in this area the monitoring system will detect the amount placed in the detection zone and consider it a buy in amount which is forwarded to a player.

It is contemplated at a similar process may occur for a check change operation wherein a player changes one denomination of checks for different denomination. The monitoring system as described herein may monitor and record the check change operation to verify the checks provided by the player to the dealer and authentic and of the proper value, i.e. not forged or altered. Likewise, the checks provided by the dealer to the player may likewise be monitored and verified.

At a step 1116, as part of the buy in operation, the monitoring system receives the designation (such as using the dealer interface) of the detection area as a buy in detection area for the purpose of this buy in and detects the checks placed in the detection zone and the buy in amount. This provides a record of the amount removed from the tray and provided to the player. Optional use of both tray monitoring and buy in monitoring via a table detection zone provides two levels of security.

Next, at a step 1118, the player may place one or more bets on the table using the DID enabled checks as received from the dealer or as brought to the table. Any type bet may be placed in accordance with the rules of play. It is contemplated that progressive, mystery, random, or any other type side or bonus bet may also be placed by the player. The monitoring system, at a step 1120 detects the player bet. In various embodiments, the level of resolution of the bet area detection system may simply detect a DID check or other element. In other embodiment, the level of resolution, which may be determined by the number of antenna, may detect each bet on each number or multiple number bets, such as corner bets.

At all time during this example method of operation, the player may optionally store their check in the check storage area. This may occur at a step 1122. Storage of check in the storage area provides additional monitoring by the monitoring system, at a step 1124, of checks in play by the player and which checks are associated with a player, the player being detectable by the dealer, biometrics, over head cameras, or any other means.

At a step 1126 the dealer may initiate movement of the roulette wheel to generate an outcome. At a step 1128 it is contemplated that the wheel may also be DID equipped. In one embodiment the wheel includes one or more antenna structure configured to detect a DID equipped ball. In other embodiment, the other configurations of DID and monitoring technology may be used to monitor one or more aspects of the wheel. By way of example and not limitation, the table monitoring system associated with the wheel may be configured to detect or monitor one or more of the following: wheel outcome, wheel speed, wheel revolutions, ball revolutions, wheel direction, and ball direction, ball revolutions, ball location, bet acceptance—cut off period or any other factor.

At some point during the rotation of the wheel before the outcome is determined or prior to rotation of the wheel, the dealer may indicated that no further bets may be placed for the current round. This may occur at step 1130. This occurs to prevent a player from watching the wheel to evaluate or predict the outcome and then placing a bet. In one embodiment wheel determines the bet cut off point in time, (when no further bets may be placed) and provides an output to indicate the same. In one embodiment the speed of the wheel, ball, or both is utilized to illuminate a bet cut off point.

In one embodiment, the dealer may utilized the dealer interface to indicated to the monitoring system when no further bets may be placed. In such an embodiment the dealer may either indicate the same to the players in the traditional manner, via a wave of the hand and arm, or a light, sound, or other indicator may be utilized. The dealer may provide an input to the monitoring system.

Figure 11A:
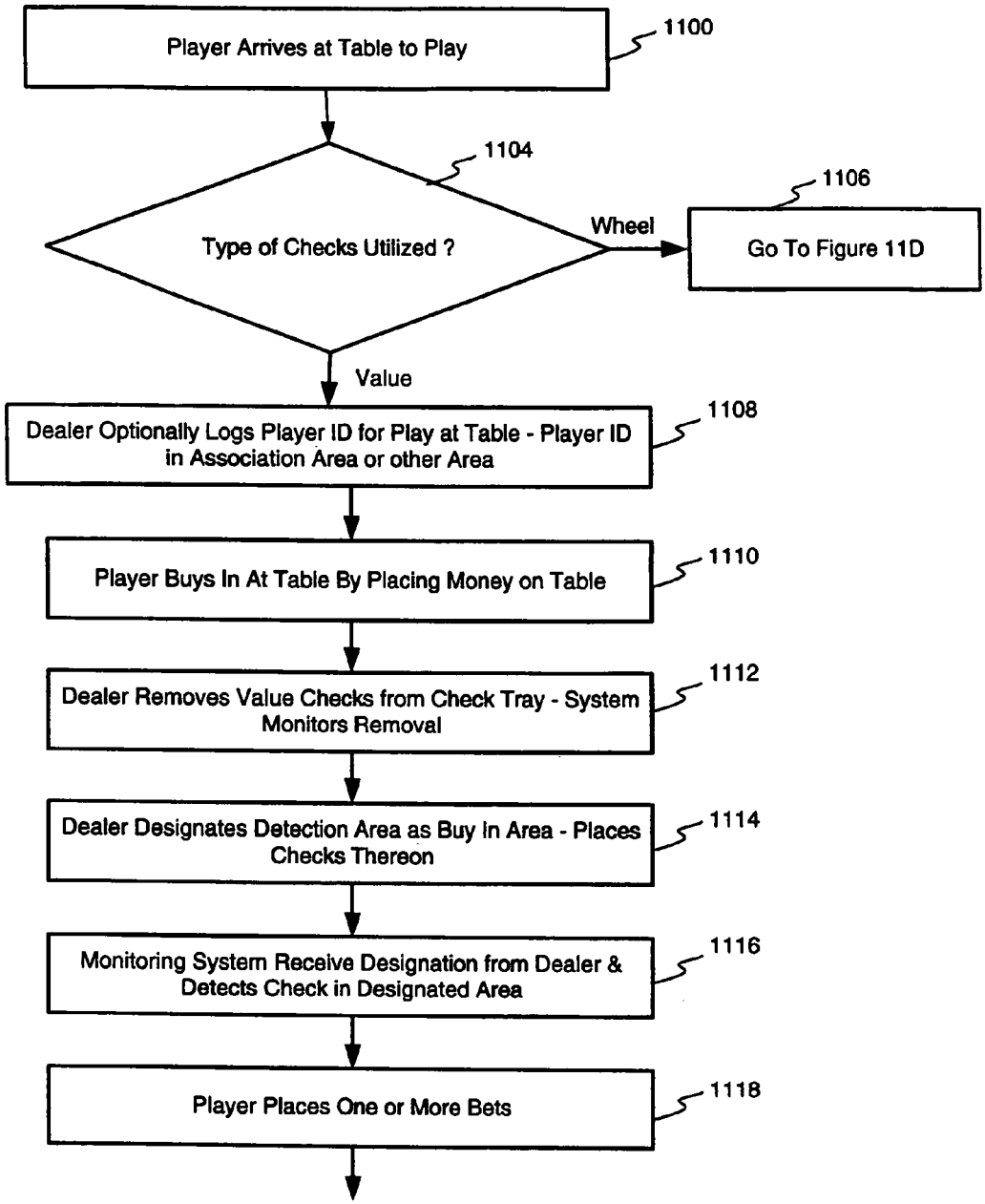
FIG. 11 illustrates an example method of play on the roulette table of FIG. 9.
Figure 11B:
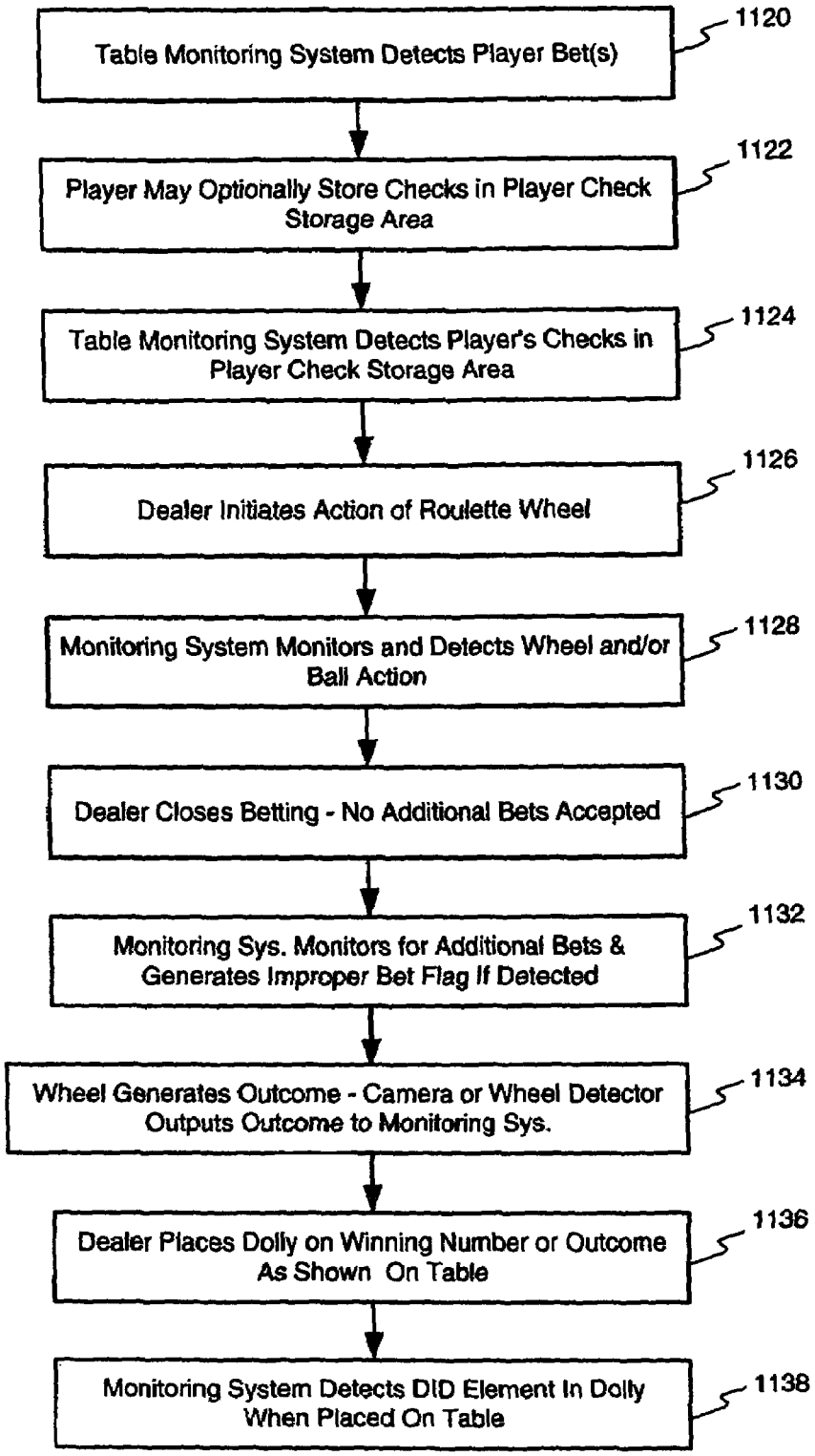

Regardless of how the monitoring system becomes aware of the bet cut off point, the monitoring system may be configured to detect any bets which are placed or moved after this point in time. Such action may generate a flag, alert or other dealer notification to thereby monitor and notify of improper actions by a player. This may occur at a step 1132 as shown in FIG. 11B.

At a step 1134 the wheel generates the outcome, which may be reported to the monitoring system via dealer input, a camera, a wheel DID element and monitoring system or any other means. Then at a step 1136, the dealer may place a dolly, marker, or other element (hereinafter dolly) on the bet area that corresponds to the outcome. In one embodiment, the dolly is DID equipped thereby allowing the maker to be read by the monitoring system. In one embodiment the location of the dolly on the betting area may be read by the monitoring system to thereby verify that the dealer is placing the dolly on the correct location or betting area and hence paying only winning bets. This occurs at a step 1138. Any level of resolution may be utilized.

The placement and detection of the dolly by the monitoring system also may indicate that a period of bet collection and payment is in progress and as such, no new bets may be placed by the players until the dealer removes the dolly. As such, the monitoring system may be configured to detect the dolly and also detect any new and different DID checks on the betting area. These new checks may be compared to checks taken from the dealer check tray. New checks detected in the betting area that did not arrive from the dealer may generate a flag, alert or other message that bets are being placed during a non-betting period and that such new checks are not from the dealer, such as to award a winning bet.

Figure 11C:
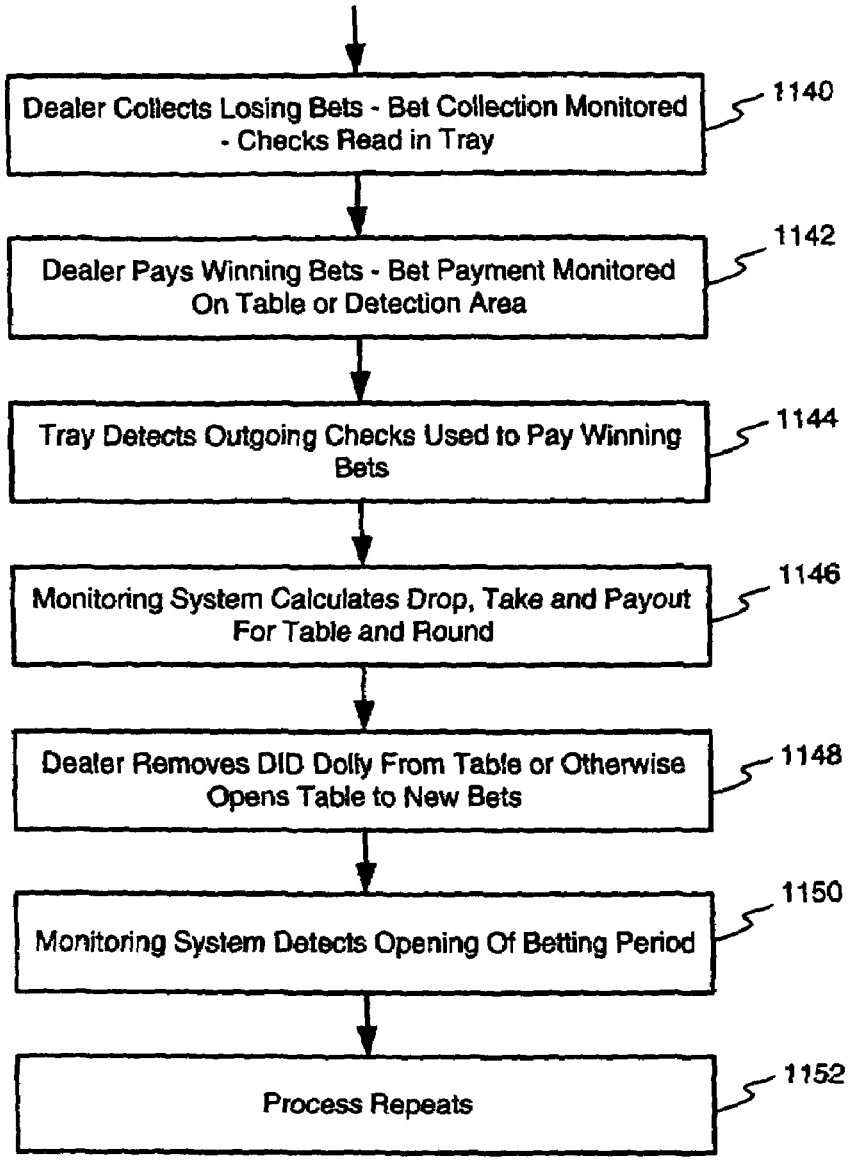

Moving to FIG. 11C, at a step 1140 the dealer may collect losing bets. The monitoring system may track losing bets, via the DID checks, from the betting area to the dealer tray. As discussed above, the tray may include monitoring capability thereby allowing the monitoring system to verify that all the losing bets were collected and placed into the tray.

At a step 1142, the dealer may pay winning wagers by retrieving checks from the tray, which is detected by the monitoring system, and paying winning wagers. Detection of outgoing checks may occur at step 1144. In one embodiment the awarded checks are placed on the betting area and detected by the detection system. In one embodiment one or more detection areas, such as areas 930 in FIG. 9, is provided for detection of payouts or the dealer, via the dealer interface, may designate a detection area for use to perform payout detection. Using either option, payouts by the dealer for winning wagers may be monitored by the detection system for any purpose including to determine that the proper amount is paid out and/or that only winning bets are paid.

At a step 1146, the table may optionally track drop for the table for the round or other period. In one embodiment drop is tracked as or defined as the buy-in amount, the winnings, or the payouts or any combination thereof.

At a step 1148, the dealer may remove the dolly from the table. This is detected by the monitoring system thereby opening the betting window for the next round play, at a step 1150. Thereafter, at a step 1152, a new round of play may begin or any other step as described herein or understood by one or ordinary skill in the art of roulette would envision utilizing the DID elements and monitored table.

Figure 11D:
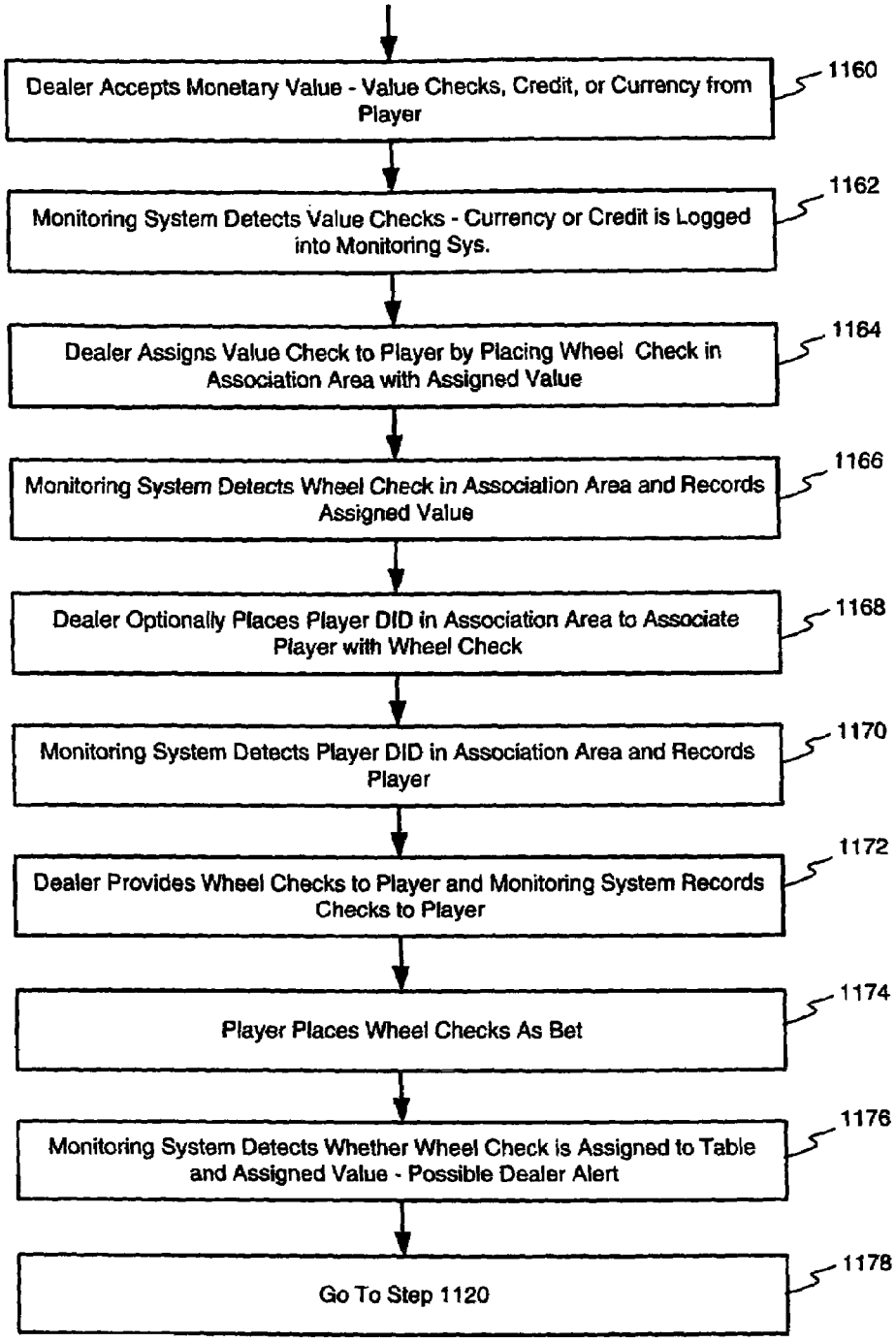

Returning now to FIG. 11A, if at step 1104 wheel checks are to be used, then the method of operation advances via step 1106 to FIG. 11D. At a step 1160, the dealer accepts monetary value from a player, such as but not limited to value checks, credit, or currency. In response, the monitoring system detects the value checks, or the currency or credit may be logged manually or automatically detected by the monitoring system. This occurs at a step 1162 and may occur in any manner described herein. At a step 1164, the dealer assigns a value to the class, color or other unique aspects of the wheel check. In one embodiment the dealer performs a write process on the checks to write player ID or player information in the DID element. For example, the dealer may designed that red wheel checks given to a first player are valued at 100 dollars each while blue wheel checks given to a second player are worth 20 dollars each.

In one embodiment this association may occur by the dealer placing a wheel check in a particular area of the association area. For example at a step 1164, the dealer may place the red wheel check in a sub-section of the association area that is labeled with a 100 dollar marking. It is contemplated that the table monitoring system may detect the placement of a particular type or class, in this example red, check in the predefined sub-section of the association area and thereby associate or assign the value of the sub-section to the class or type of wheel check. This may occur in step 1166.

In one embodiment the association area may not have sub-sections or the sub-sections may not be labeled with denomination information. As a result, the dealer may set the value assigned to the wheel checks by placing an exemplary wheel check in the association area and placing a value token on the wheel check or in the same sub-section of the association area. Thereafter, the detector of the association area will report to the monitoring system the association established by the dealer. The monitoring system will detect the association by the dealer of a particular type or class of wheel check with the value check and record futures bets using the same type or class of wheel checks at the assigned denomination. In other embodiments the dealer may use a denomination indicator that is DID equipped, instead of a DID value check to establish the association. One example of a denomination indicator is a DID equipped dolly or marker.

At a step 1168 the dealer may receive from a player a DID equipped player device, such as player tracking card. The dealer may also place the player DID element in the association area to associate the wheel checks with the player. The monitoring system will read the player DID element. Alternatively, the dealer may log the player into the player tracking and/or monitoring system in any other manner.

At a step 1170, the monitoring system detects the player DID in the association area or other area of the table thereby recording the player as playing at the table with a value of wheel check. Turn over for that player at the wheel check value may be tracked.

At a step 1172, the dealer may provide the wheel checks to the player and the monitoring system may detect the transfer of the wheel checks to the player. As described above, any manner of transfer and monitoring of the transfer to the player from the dealer may be made such that detection by the monitoring system may occur.

At a step 1174, the player may place one or more bets using the wheel checks anywhere on the bet area. It is contemplated that at step 1176 the monitoring system will detect the wheel checks and verify, through a comparison process that the wheel checks are associated with this table. As way of background, in a casino having more than one roulette table, the wheel checks may have a visual table designation that associates the wheel check with a particular table. This prevents a player from purchasing red wheel checks at a first table for 20 dollars and later playing them at another table where they are valued at 100 dollars. When wheel checks are stacked or other located under value checks the dealer may not notice the table designator and consequently errors may occur because wheel checks from other tables may be placed on the wrong table. In one embodiment, the DID wheel checks are encoded or contain table designation in memory and when read by the monitoring system the monitoring system may compare the table to the table designator stored on the wheel check to verify if the wheel check is authorized for play on this particular table.

If the wheel check is authorized for use on this table and a value has been assigned, the play may continue. Alternatively, if the wheel check table designation is not confirmed as being associated with this particular table, then the monitoring system may alert the dealer, or in any other manner generate an alert. Thereafter, the operation advances to step 1178 wherein the method of operation returns to step 1120.

While various embodiments of the invention have been described, it will be apparent to those of ordinary skill in the art that many more embodiments and implementations are possible that are within the scope of this invention.

The invention claimed is:

1. A roulette game wager detection system comprising:

an antenna configured to establish a detection zone associated with a plurality of wagering areas and an association area on a game table surface and to detect each of a plurality of tokens placed within a plurality of the wagering areas by a plurality of different players, wherein:

(a) each of the tokens:

(i) is included in a token set of a designated number of token sets, wherein each of the token sets:

(A) is associated with a different one of a plurality of different token colors, and (B) includes a plurality of the tokens having the token color associated with said token set, (ii) includes a token identification element, and (iii) includes a token memory storing token data, wherein the token data includes a token value, a token serial number, and a token color identification code, the token color identification code identifying the token color of said token, the token color identified by the token color identification code being assignable to one of the different players, (b) each of the wagering areas is:

(i) associated with a different one of a plurality of different wager options, and (ii) configured to receive at least one of the tokens from a plurality of the different players; and (c) the association area is different from the wagering areas;

a reader connected to the antenna, wherein the reader is configured to:

(a) when a first one of the tokens having a first one of the token colors assigned to a first one of the different players and a second one of the tokens having a second different one of the token colors assigned to a second one of the different players are located within a same one of the wagering areas:

(i) read the token data of the first one of the tokens and the second one of the tokens, the token data of the first one of the tokens including a first token color identification code identifying the first one of the token colors, the token data of the second one of the tokens including a second token color identification code identifying the second one of the token colors, and (ii) communicate the first token color identification code and the second token color identification code to a processor to enable the processor to determine that wagers from the first one of the different players and the second one of the different players are located within the same one of the wagering areas; and (b) when a third one of the tokens is located within the association area, read the token data of the third one of the tokens and operate with the processor to assign the third one of the tokens a value associated with the association area, and a dealer interface configured to enable a dealer to:

(a) indicate that all wagers for a round of play of the roulette game have been placed, and (b) activate the reader.

2. The roulette game wager detection system of claim 1, wherein the game table surface is configured in a roulette table layout.

3. The roulette game wager detection system of claim 1, wherein the processor is configured to track a total value of wagers made using the tokens having the same token color identification code.

4. The roulette game wager detection system of claim 1, wherein the processor is configured to determine if at least one of the tokens located within at least one of the wagering areas or the association area satisfies predetermined game rules and, if the predetermined game rules are not satisfied, to generate an alert.

5. The roulette game wager detection system of claim 1, which includes a roulette wheel monitor configured to detect a status of a roulette wheel.

6. The roulette game wager detection system of claim 1, wherein the reader is configured to, when a fourth one of the tokens and a fourth player identification element are located within a second association area on the game table surface:

(a) read a fourth player identification data stored on the fourth player identification element and the token data of the fourth one of the tokens, the token data of the fourth one of the tokens including a fourth token color identification code identifying a fourth token color, the fourth player identification data identifying a fourth player, and (b) communicate the fourth token color identification code and the fourth player identification data to the processor to enable the processor to assign the fourth token color to the fourth player.

7. A method of identifying wagering activity during a game of roulette, said method comprising the steps of:

establishing, with an antenna, a detection zone associated with a plurality of wagering areas and an association area on a game table surface, the antenna being configured to detect each of a plurality of tokens placed within a plurality of the wagering areas by a plurality of different players, the association area being different from the wagering areas, each of the wagering areas being:

(a) associated with a different one of a plurality of different wager options, and (b) configured to receive at least one of the tokens from a plurality of the different players;

causing a processor to assign a first one of a plurality of different token colors to a first one of the different players and a second different one of the token colors to a second one of the different players, wherein:

(a) each of the token colors is associated with a different one of a designated number of token sets, each of the token sets being comprised of a plurality of the tokens of the token color associated with said token set, and (b) each of the tokens includes a token identification element and a memory, the memory storing token data including a token value, a token serial number, and a token color identification code, the token color identification code identifying the token color of said token;

detecting, with the antenna:

(a) a first one of the tokens having the first one of the token colors and a second one of the tokens having the second different one of the token colors located within a same one of the wagering areas, the first one of the tokens including a first token color identification code identifying the first one of the token colors, the second one of the tokens including a second token color identification code identifying the second different one of the token colors; and (b) a third one of the tokens within the association area;

activating a reader, wherein the reader is configured to read the token data of each of a plurality of the tokens placed on the same one of the wagering areas by the different players; and causing the reader to:

(a) read the token data of the first one of the tokens and the second one of the tokens, and communicate the read token data to the processor to enable the processor to determine that wagers from the first one of the different players and the second one of the different players are located within the same one of the wagering areas and to calculate the amount wagered by the first one of the different players and the amount wagered by the second one of the different players; and (b) read the token data of the third one of the tokens and operate with the processor to assign the third one of the tokens a value associated with the association area.

8. The method of claim 7, which includes:

(a) detecting, with the antenna, a fourth one of the tokens and a fourth player identification element within a second association area on the game table surface, and (b) causing the reader to:

(a) read a fourth player identification data stored on the player identification element and the token data of the fourth one of the tokens, the token data of the fourth one of the tokens including a fourth token color identification code identifying a fourth token color, the fourth player identification data identifying a fourth player; and (b) communicate the fourth token color identification code and the fourth player identification data to the processor to enable the processor to assign the fourth token color to the fourth player.

9. The method of claim 8, wherein the association area comprises an area of the game table surface having the antenna in proximity thereto to detect both the player identification data and the token color identification code.

10. The method of claim 7, further comprising causing the processor to provide a comp award to one of the different players based on the amount wagered by said player, wherein the processor determines the amount wagered by said player based on token data read by the reader, wherein the processor provides the comp award regardless of the outcome of the game of roulette.

11. The method of claim 7, wherein the token identification element comprises a radio frequency identification tag.

12. The method of claim 7, further comprising generating an alert if a wager violates a wagering rule.

* * * * *

UNITED STATES PATENT AND TRADEMARK OFFICE

CERTIFICATE OF CORRECTION

PATENT NO. : 8,092,293 B2
APPLICATION NO. : 11/520854
DATED : January 10, 2012
INVENTOR(S) : Tim Richards et al.

It is certified that error appears in the above-identified patent and that said Letters Patent is hereby corrected as shown below:

IN THE CLAIMS:

In Claim 3, column 29, line 51, after “having” replace “the” with --a--.

In Claim 6, column 30, line 3, before “token” add --one of the--.

In Claim 6, column 30, line 3, replace “color” with --colors--.

In Claim 6, column 30, line 7, before “token” add --one of the--.

In Claim 6, column 30, line 7, replace “color” with --colors--.

In Claim 7, column 30, line 58, before “amount” replace “the” with --an--.

In Claim 7, column 30, line 59, before “amount” replace “the” with --an--.

In Claim 8, column 31, line 6, before “token” add --one of the--.

In Claim 8, column 31, line 6, replace “color” with --colors--.

In Claim 8, column 31, line 12, before “token” add --one of the--.

In Claim 8, column 31, line 12, replace “color” with --colors--.

In Claim 10, column 32, line 5, before “amount” replace “the” with --an--.

Signed and Sealed this
Twentieth Day of March, 2012

David J. Kappos

David J. Kappos
*Director of the United States Patent and Trademark Office*